US006018316A

United States Patent [19]

Rudish et al.

[11] Patent Number: 6,018,316

[45] Date of Patent: Jan. 25, 2000

[54] MULTIPLE BEAM ANTENNA SYSTEM AND METHOD

[75] Inventors: Ronald M. Rudish, Bethpage; Joseph S. Levy, Merrick; Peter J. McVeigh, Hauppauge, all of N.Y.

[73] Assignee: AIL Systems, Inc., Deer Park, N.Y.

[21] Appl. No.: 08/861,358

[22] Filed: May 21, 1997

Related U.S. Application Data

[60] Provisional application No. 60/036,361, Jan. 24, 1997.

[51] Int. Cl.[7] ..... H01Q 21/06

[52] U.S. Cl. ..... 342/361; 342/81; 342/363; 342/368

[58] Field of Search ..... 342/363, 366, 342/368, 361, 81, 154, 354

[56] References Cited

U.S. PATENT DOCUMENTS

| | | | |
|---|---|---|---|
| 4,236,161 | 11/1980 | Ohm | 343/78 CA |
| 4,315,262 | 2/1982 | Acampora et al. | 343/100 S |
| 4,482,897 | 11/1984 | Dragone et al. | 343/775 |
| 4,626,858 | 12/1986 | Copeland | 342/374 |
| 4,931,802 | 6/1990 | Assal et al. | 342/356 |
| 5,115,248 | 5/1992 | Roederer | 342/373 |

*Primary Examiner*—Thomas H. Tarcza
*Assistant Examiner*—Dao L. Phan
*Attorney, Agent, or Firm*—Hoffmann & Baron, LLP

[57] ABSTRACT

A satellite based signal transmission and reception system which generates multiple beams with low side lobes and minimal crossover losses. The system includes a focusing device and an array of signal generator elements coupled to feed radiator elements. The feed radiator elements are assigned into overlapping beam sub-arrays characterized by a frequency and radiated beam polarization. Each overlapping sub-array generates a transmission beam signal which is orthogonally polarized with respect to the beam generated by the other overlapping sub-array. The use of beam orthogonality provides for physically overlapping beam sub-arrays without the use of analog combining networks which are inherently lossy structures. This allows beams to be generated having a highly tapered amplitude distribution to simultaneously achieve low side lobe levels and low beam cross over losses. By employing multiple signal generators driving the transmission elements of the beam sub-arrays, the transmission system is able to step the transmit signals along the feed radiator array to compensate for satellite motion without the use of complex RF switching networks. In an analogous fashion, antenna elements in an array receive multiple transmission beam signals which are incident upon a focusing device. The antenna elements are dynamically assigned to overlapping receive beam sub-arrays which are orthogonally polarized. The multiple beam receiving system is able to step the received signal sub-arrays along the array to compensate for satellite motion.

39 Claims, 22 Drawing Sheets

FIG-6

36

12

| | | | | |
|---|---|---|---|---|
| FE11 RH<br>FE11 LH | FE12 RH<br>FE12 LH | FE13 RH<br>FE13 LH | FE14 RH<br>FE14 LH | FE15 RH<br>FE15 LH |
| FE21 RH<br>FE21 LH | FE22 RH<br>FE22 LH | FE23 RH<br>FE23 LH | FE24 RH<br>FE24 LH | FE25 RH<br>FE25 LH |
| FE31 RH<br>FE31 LH | FE32 RH<br>FE32 LH | FE33 RH<br>FE33 LH | FE34 RH<br>FE34 LH | FE35 RH<br>FE35 LH |
| FE41 RH<br>FE41 LH | FE42 RH<br>FE42 LH | FE43 RH<br>FE43 LH | FE44 RH<br>FE44 LH | FE45 RH<br>FE45 LH |
| FE51 RH<br>FE51 LH | FE52 RH<br>FE52 LH | FE53 RH<br>FE53 LH | FE54 RH<br>FE54 LH | FE55 RH<br>FE55 LH |
| FE61 RH<br>FE61 LH | FE62 RH<br>FE62 LH | FE63 RH<br>FE63 LH | FE64 RH<br>FE64 LH | FE65 RH<br>FE65 LH |
| FE71 RH<br>FE71 LH | FE72 RH<br>FE72 LH | FE73 RH<br>FE73 LH | FE74 RH<br>FE74 LH | FE75 RH<br>FE75 LH |
| FE81 RH<br>FE81 LH | FE82 RH<br>FE82 LH | FE83 RH<br>FE83 LH | FE84 RH<br>FE84 LH | FE85 RH<br>FE85 LH |
| FE91 RH<br>FE91 LH | FE92 RH<br>FE92 LH | FE93 RH<br>FE93 LH | FE94 RH<br>FE94 LH | FE95 RH<br>FE95 LH |

SIGNAL STEPS HALF BEAM

FIG-6D

Table 1: Signal Assignments by Feed Element and Beam for Figure 6A

| Signal | FE's | Beam |
|---|---|---|
| Signal A | FE11 RH, FE12 RH, FE21 RH, FE22 RH | Beam 1 |
| Signal B | FE31 RH, FE32 RH, FE41 RH, FE42 RH | Beam 2 |
| Signal C | FE51 RH, FE52 RH, FE61 RH, FE62 RH | Beam 3 |
| Signal D | FE71 RH, FE72 RH, FE81 RH, FE82 RH | Beam 4 |
| Signal E | FE22 LH, FE23 LH, FE32 LH, FE33 LH | Beam 5 |
| Signal F | FE42 LH, FE43 LH, FE52 LH, FE53 LH | Beam 6 |
| Signal G | FE62 LH, FE63 LH, FE72 LH, FE73 LH | Beam 7 |
| Signal H | FE82 LH, FE83 LH, FE92 LH, FE93 LH | Beam 8 |
| Signal I | FE13 RH, FE14 RH, FE23 RH, FE24 RH | Beam 9 |
| Signal J | FE33 RH, FE34 RH, FE43 RH, FE44 RH | Beam 10 |
| Signal K | FE53 RH, FE54 RH, FE63 RH, FE64 RH | Beam 11 |
| Signal L | FE73 RH, FE74 RH, FE83 RH, FE84 RH | Beam 12 |
| Signal M | FE24 LH, FE25 LH, FE34 LH, FE35 LH | Beam 13 |
| Signal N | FE44 LH, FE45 LH, FE54 LH, FE55 LH | Beam 14 |
| Signal O | FE64 LH, FE65 LH, FE74 LH, FE75 LH | Beam 15 |
| Signal P | FE84 LH, FE85 LH, FE94 LH, FE95 LH | Beam 16 |

FIG-6E

Table 2: Feed Element Assignments By Beam for Figure 6B

| Signal | FE's | Beam |
|---|---|---|
| Signal A | FE21 RH, FE22 RH, FE31 RH, FE32 RH | Beam 1.5 |
| Signal B | FE41 RH, FE42 RH, FE51 RH, FE52 RH | Beam 2.5 |
| Signal C | FE61 RH, FE62 RH, FE71 RH, FE72 RH | Beam 3.5 |
| Signal D | FE81 RH, FE82 RH, FE91 RH, FE92 RH | Beam 4.5 |
| Signal E | FE32 LH, FE33 LH, FE42 LH, FE43 LH | Beam 5.5 |
| Signal F | FE52 LH, FE53 LH, FE62 LH, FE63 LH | Beam 6.5 |
| Signal G | FE72 LH, FE73 LH, FE82 LH, FE83 LH | Beam 7.5 |
| Signal H | FE12 LH, FE13 LH, FE22 LH, FE23 LH | Beam 8.5 |
| Signal I | FE23 RH, FE24 RH, FE33 RH, FE34 RH | Beam 9.5 |
| Signal J | FE43 RH, FE44 RH, FE53 RH, FE54 RH | Beam 10.5 |
| Signal K | FE63 RH, FE64 RH, FE73 RH, FE74 RH | Beam 11.5 |
| Signal L | FE83 RH, FE84 RH, FE93 RH, FE94 RH | Beam 12.5 |
| Signal M | FE34 LH, FE35 LH, FE44 LH, FE45 LH | Beam 13.5 |
| Signal N | FE54 LH, FE55 LH, FE64 LH, FE65 LH | Beam 14.5 |
| Signal O | FE74 LH, FE75 LH, FE84 LH, FE85 LH | Beam 15.5 |
| Signal P | FE14 LH, FE15 LH, FE24 LH, FE25 LH | Beam 16.5 |

FIG-6F

Table 3: Feed Element Assignments By Beam for Figure 6C

| Signal | FE's | Beam |
|---|---|---|
| Signal A | FE31 RH, FE32 RH, FE41 RH, FE42 RH | Beam 2 |
| Signal B | FE51 RH, FE52 RH, FE61 RH, FE62 RH | Beam 3 |
| Signal C | FE71 RH, FE72 RH, FE81 RH, FE82 RH | Beam 4 |
| Signal D | FE11 RH, FE12 RH, FE21 RH, FE22 RH | Beam 5 |
| Signal E | FE42 LH, FE43 LH, FE52 LH, FE53 LH | Beam 6 |
| Signal F | FE62 LH, FE63 LH, FE72 LH, FE73 LH | Beam 7 |
| Signal G | FE82 LH, FE83 LH, FE92 LH, FE93 LH | Beam 8 |
| Signal H | FE22 LH, FE23 LH, FE32 LH, FE33 LH | Beam 9 |
| Signal I | FE33 RH, FE34 RH, FE43 RH, FE44 RH | Beam 10 |
| Signal J | FE53 RH, FE54 RH, FE63 RH, FE64 RH | Beam 11 |
| Signal K | FE73 RH, FE74 RH, FE83 RH, FE84 RH | Beam 12 |
| Signal L | FE13 RH, FE14 RH, FE23 RH, FE24 RH | Beam 13 |
| Signal M | FE44 LH, FE45 LH, FE54 LH, FE55 LH | Beam 14 |
| Signal N | FE64 LH, FE65 LH, FE74 LH, FE75 LH | Beam 15 |
| Signal O | FE84 LH, FE85 LH, FE94 LH, FE95 LH | Beam 16 |
| Signal P | FE24 LH, FE25 LH, FE34 LH, FE35 LH | Beam 17 |

MULTIPLE BEAM ANTENNA SYSTEM AND METHOD

This application claims the benifit of U.S. Provisional Application Ser. No. 60/036,361 entitled "Multiple Beam Transmission System and Method," filed Jan. 24, 1997.

BACKGROUND OF THE INVENTION

1. Field of the Invention

The present invention relates generally to satellite based signal antenna systems, and more particularly relates to a satellite based antenna for generating or receiving multiple transmission beams.

2. Description of the Prior Art

In satellite signal transmission systems, it is often desirable to send multiple transmission signals from a single antenna. This provides for increased signal throughput and/or increased signal coverage area. An array antenna, or an antenna using multiple antenna feed elements and a focusing device is conventionally used to perform this task.

A conventional multiple-beam antenna, known in the prior art, is illustrated in FIG. 1. Referring to FIG. 1, a series of antenna feeds 2 each generate a transmission beam signal which illuminates a focusing device 4, such as a lens or reflector. The focusing device 4 illustrated in FIG. 1 is a lens. The antenna feeds 2 are physically arranged along a focal arc and are positioned at various angles with respect to the normal to the focusing device to provide multiple contiguous beams in directions aligned with the vectors from feed centers to lens center. Typically, the antenna feed spacing along the focal arc is configured to establish beam crossover (overlap) at the half power (3 dB) point 6 of the beams. Also, typically, antenna feed width is chosen equal to the spacing between antenna feeds. As a result, the half-power (3 dB) beamwidth of each feed antenna is approximately equal to the included angle of the lens 4. Thus the lens illumination taper is only 3 dB.

The transmission beams typically contain a main signal lobe and one or more side lobes. To achieve suppression of side lobes from each transmission beam, a taper greater than 3 dB is required. In practice, for reasonable side lobe suppression, a taper of 12 dB or more is required. Referring to FIG. 1, each antenna feed element 2 is at least partially defined by a feed diameter, d. To achieve the desired illumination taper, the feed diameter of each element must be equal to twice the arc distance, $d_a$, separating adjacent antenna feeds 2. This requirement dictates that adjacent antenna feeds either physically overlap or be spread apart to twice the angular separation, thus illuminating every other beam. However, configuring the array of FIG. 1 with twice the angular separation and half the beams would result in severe beam crossover losses.

The above-mentioned limitations were identified and explored in the article "Pattern Limitations in Multiple-Beam Antennas" by W. D. White, *IRE Transactions on Antennas and Propagation,* 430–436 (1962), which is hereby incorporated by reference. To overcome these problems, the White article discloses a beam combining network which provides for beam overlap and thus suppressed side lobes and low crossover losses. However, the beam combining network approach accomplishes this by introducing significant signal loss (terminations on combiners). White suggests that this loss can be masked by insertion of an amplifier between each feed element and the network. However, in such an approach, the amplifier must process multiple signals simultaneously (the signals from the adjacent overlapped beams). In signal transmission applications, this is a disadvantage because of the possibility of intermodulation distortion occurring between the multiple, high-level signals.

The White article also discusses an alternative arrangement which achieves beam overlap by supplying alternate beams from two separate antennas. This alternative arrangement uses an odd-beam antenna and an even beam antenna. This configuration has the obvious disadvantage of requiring twice as much apparatus and twice as much volume as compared to a single antenna array.

OBJECTS AND SUMMARY OF THE INVENTION

It is an object of the present invention to provide a multiple beam transmission antenna featuring a highly tapered antenna aperture illumination for suppressed side lobes.

It is another object of the present invention to provide a multiple beam antenna with beams which can be assigned to multiple transmitter signals in a spacial sequence, and that sequence can be stepped to compensate for satellite motion without the use of an RF switching matrix.

It is another object of the present invention to provide a multiple beam array antenna which features a low side lobe signal strength and low beam cross over losses.

It is yet another object of the present invention to provide a multiple beam antenna which achieves low beam crossover loss and low side lobe signal strength without employing a lossy signal combiner network.

It is yet another object of the present invention to provide a multiple beam transmission system using a single antenna which supports multiple transmission beams to reduce the cost and weight of the system.

It is a further object of the present invention to provide a multiple beam array antenna which provides substantially uniform coverage when beams are projected onto a spherical target.

It is still a further object of the present invention to provide a multiple beam transmission system wherein signal power amplifiers receive and amplify only a single signal to reduce intermodulation distortion.

In accordance with one form of the present invention, a multiple beam transmission antenna is formed from a plurality of antenna feed elements. Each antenna feed element is capable of receiving and radiating a first and a second signal. The first signal from each antenna feed element is radiated with a first signal polarization. The second signal from each antenna feed element is radiated with a second signal polarization which is orthogonal to the first. The antenna feed elements are constituents of feed beam sub-arrays. Each beam sub-array is made up of a predetermined number of antenna elements which receive a common first signal and establish a transmit beam for that signal.

The beam sub-arrays for adjacent transmit beams overlap. The sub-array overlap is achieved by applying a common second signal to a portion of the elements in a first sub-array and to a portion of the elements in an adjacent second sub-array. The second transmission beam is radiated with a polarization which is orthogonal to the first transmission beam. This allows the beam sub-arrays to physically overlap without incurring excessive signal loss and without coupling each signal into the other's beam.

The beams radiating from each of the sub-arrays illuminate a focusing device, such as a lens or reflector. A beam sub-array size and location with respect to the focusing device and/or the shape of the focusing device serve to pre-shape the beam patterns to provide uniform coverage of the multiple beams when projected on a spherical target.

These and other objects, features and advantages of the present invention will become apparent from the following detailed description of illustrative embodiments thereof, which is to be read in connection with the accompanying drawings.

BRIEF DESCRIPTION OF THE DRAWINGS

FIG. 6 is a pictorial diagram illustrating a five element by nine element rectangular array formed in accordance with the present invention, with feed elements identified by column and row number.

FIGS. 6D–F are tables illustrating beam sub-array assignments for beams in FIGS. 6A–C respectively.

DETAILED DESCRIPTION OF THE PREFERRED EMBODIMENTS

Figure 1:
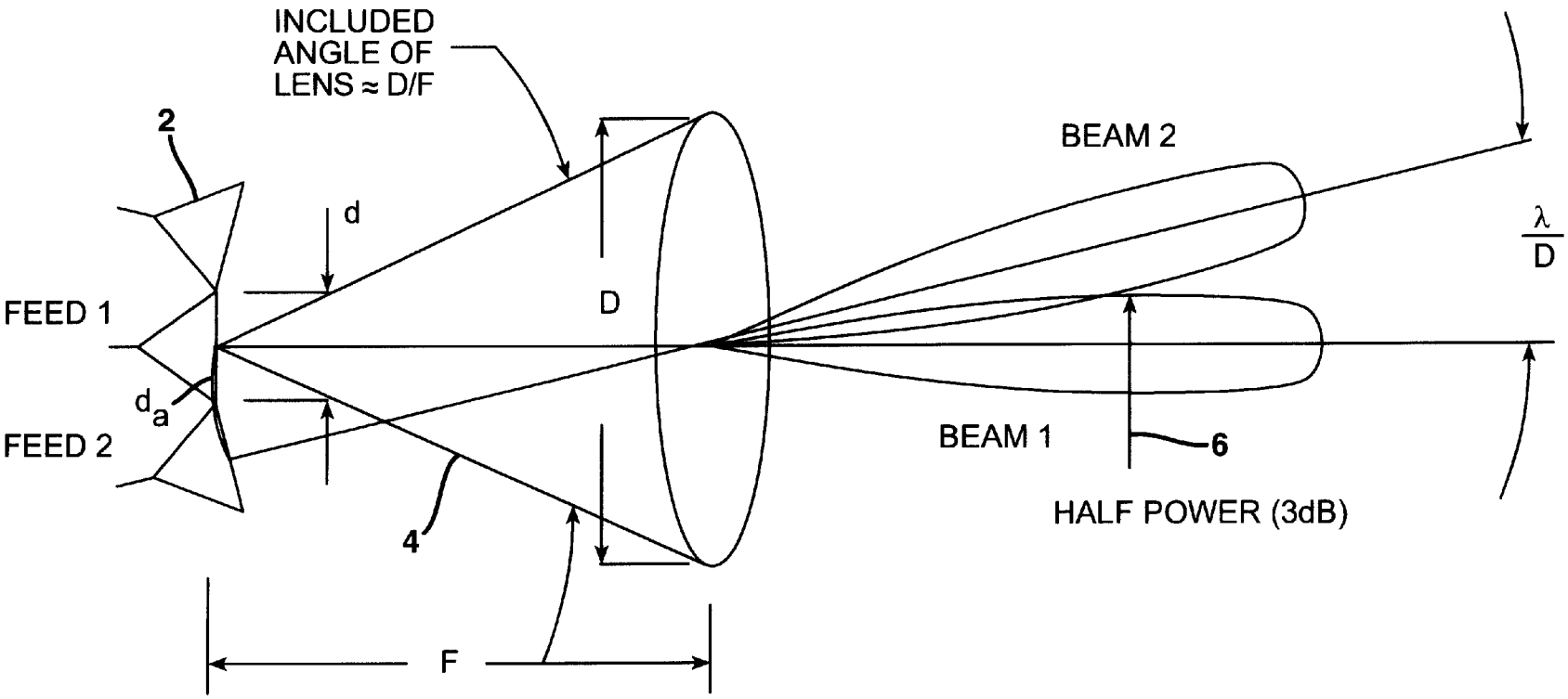
FIG-1 PRIOR ART
FIG. 1 is a pictorial diagram of a multiple beam transmission system known in the prior art.
Figure 2:
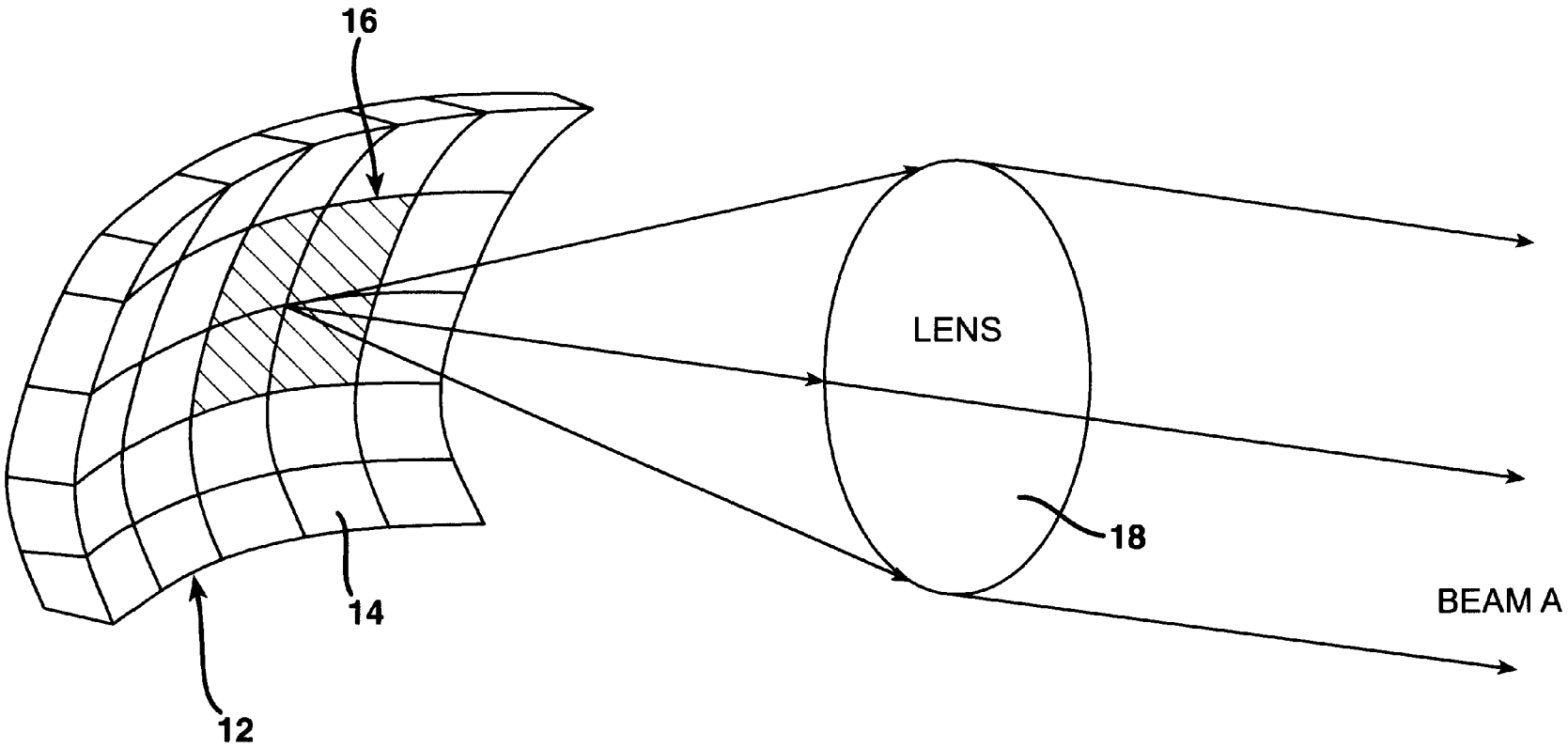
FIG. 2 is a perspective pictorial diagram of a multiple beam transmission system formed in accordance with the present invention.

FIG. 2 illustrates a pictorial diagram of a multiple beam transmission system formed in accordance with the present invention. Referring to FIG. 2, an antenna array 12 is formed from an assembly of adjacent antenna elements 14. Groups of adjacent antenna elements 14 are operated as beam sub-arrays 16 to generate a plurality of transmit beam signals. Each transmit beam signal is presented to focusing means 18, such as a lens or a reflector. The array geometry and construction of the focusing means are selected to establish a uniform coverage on a spherical target, such as a planet, when the transmission system of the present invention is employed in an orbiting satellite system.

Each antenna element 14 includes at least one signal generator element 22. The signal generator element 22 is illustrated in the block diagram of FIG. 3. The signal generator element 22 is capable of generating a signal which is frequency agile and can be phase or frequency modulated. This provides for the generation of signals which are suitable for Frequency Division Multiple Access (FDMA) and/or Code Division Multiple Access (CDMA) systems. Preferably, the signal generator element 22 includes a direct digital synthesizer (DDS) 24.

The multiple beam transmission system also includes a DDS phase clock 26 which generates a DDS phase clock signal. Each DDS 24 receives the common DDS phase clock signal. Each DDS 24 generates an analog sub-carrier transmission signal in response to commands received from a common digital processor 28.

Figure 4:
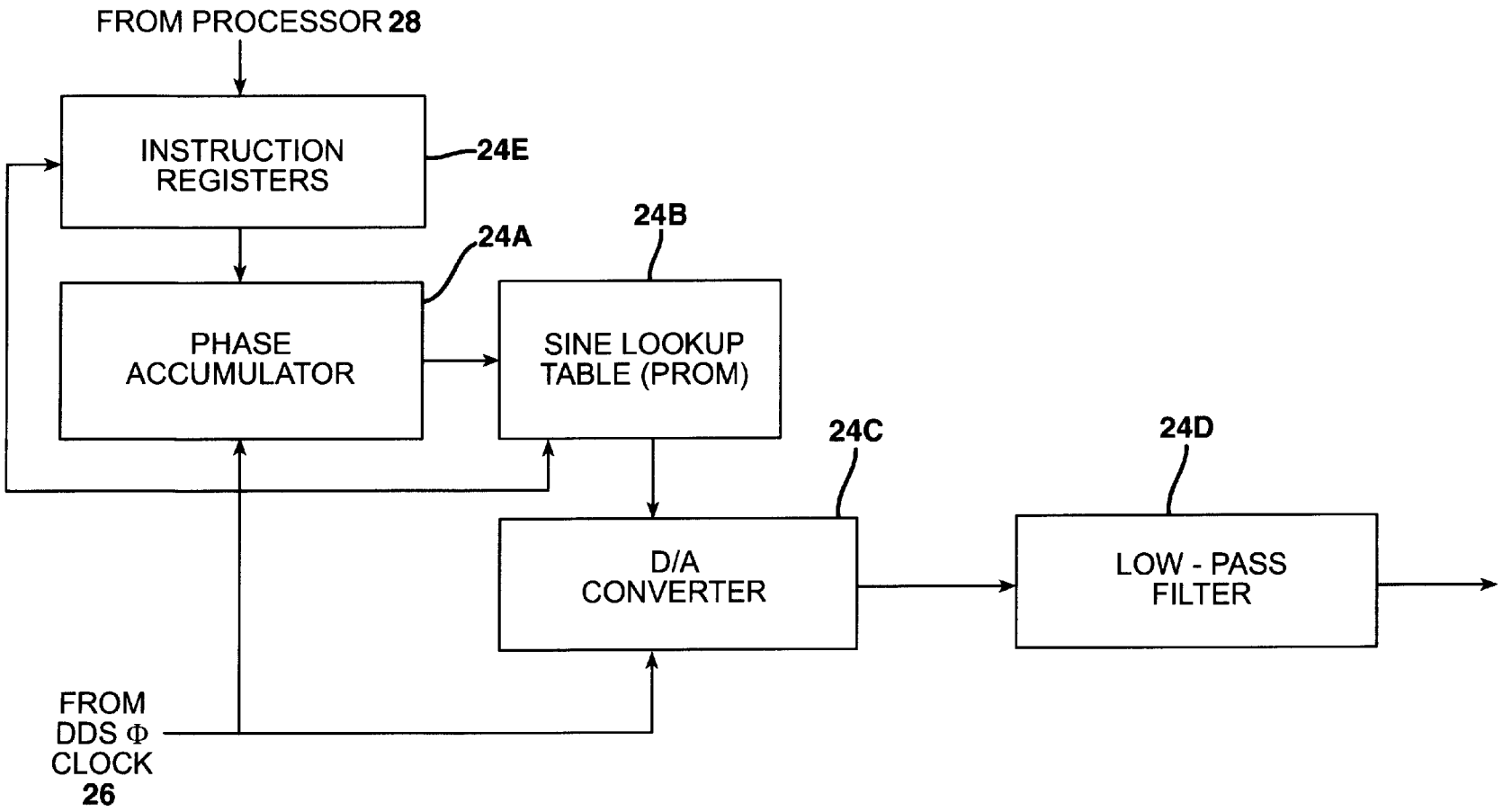
FIG. 4 is a block diagram of a direct digital synthesizer used to implement a preferred embodiment of the present invention.

The DDS 24 is illustrated in further detail in the block diagram of FIG. 4. The DDS 24 is known in the prior art. The DDS 24 includes a phase accumulator 24A which generates an address signal. A sine look-up table 24B is responsive to the address signal and generates a digital sine wave signal. The digital sine wave signal from the sine look-up table 24B is operatively coupled to a digital-to-analog (D/A) converter 24C. The D/A converter 24C creates an analog sub-carrier signal. The DDS phase clock signal is operatively coupled to both the phase accumulator 24A and the D/A converter 24C and synchronizes the operation of these two operating blocks.

The DDS 24 preferably includes a low pass filter 24D which is operatively coupled to the D/A converter 24C and receives the analog sub-carrier signal. The low pass filter 24D smooths the output from the D/A converter 24C and provides an output signal with reduced spurious content. Preferably, the DDS 24 further includes instruction registers 24E. The instruction registers 24E receive digital instructions from the common digital processor 28 and synchronize the operation of the DDS 24 according to these instructions. In response to the received instructions, the DDS 24 can change the frequency of operation and impart phase modulation or frequency modulation upon the analog sub-carrier signal.

Because of the limited high frequency operating range of a conventional DDS, each signal generator element 22 preferably includes an upconverter circuit. The upconverter circuit receives the analog sub-carrier signal from the DDS 24 and transposes this signal to a higher frequency of operation. The upconverter may take the form of a frequency multiplier circuit or hetrodyning circuit. A hetrodyning circuit is illustrated in FIG. 3.

The hetrodyning circuit includes a mixer 30 and a common local oscillator (LO) 32. Each mixer 30 is responsive to both an LO signal from the LO 32 and the sub-carrier signal from the DDS 24. Preferably, the mixer 30 is a single side band device which only generates a signal representing the sum of the two received signals while suppressing all other signals. If a general purpose mixer is used, the output will typically contain a plurality of signals in addition to the desired sum signal. In this case, it may be desirable to operatively couple a filter to the output signal of the mixer 30 to remove the unwanted signal components.

Figure 3:
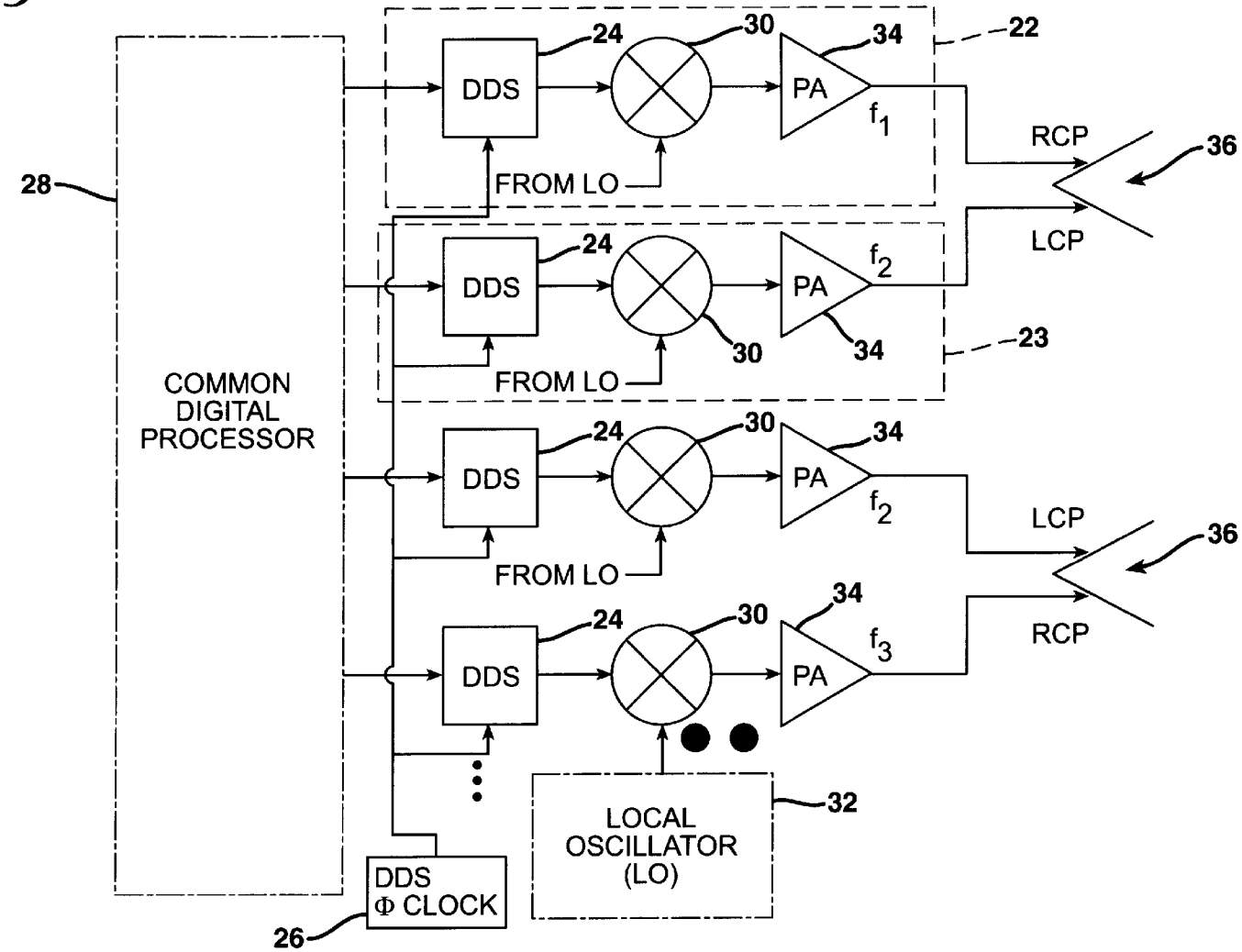
FIG. 3 is a block diagram of a multiple beam transmission system formed in accordance with the present invention.

The signal generator element 22 illustrated in FIG. 3 preferably includes at least one signal amplifier 34. The signal amplifier 34 receives the output signal from the mixer 30 and performs conventional signal amplification to this signal. While the amplifier is shown as a single block, the signal amplifier 34 will typically be formed from several cooperative amplification stages to achieve the desired output power level.

Each antenna element 14 further includes a feed radiator 36. Each feed radiator 36 is operatively coupled to two signal generator elements 22. The feed radiator 36 receives a first signal from a first signal generator element 22 and radiates this signal with a first signal polarization. Preferably, the feed radiator 36 receives a second signal from a second signal generator element 23 and radiates this signal with a second polarization. The feed radiator 36 is selected such that the first and second polarizations are mutually orthogonal. This can be achieved by vertical/horizontal polarization, or preferably, right circular (RCP)/left circular (LCP) polarization. By propagating two signals with orthogonal polarization, each feed radiator 36 may contribute to two overlapping transmit beam sub-arrays 16. This overlap allows the present invention to achieve a highly tapered amplitude distribution across the aperture of the focusing device.

Figures 5A, 5B:
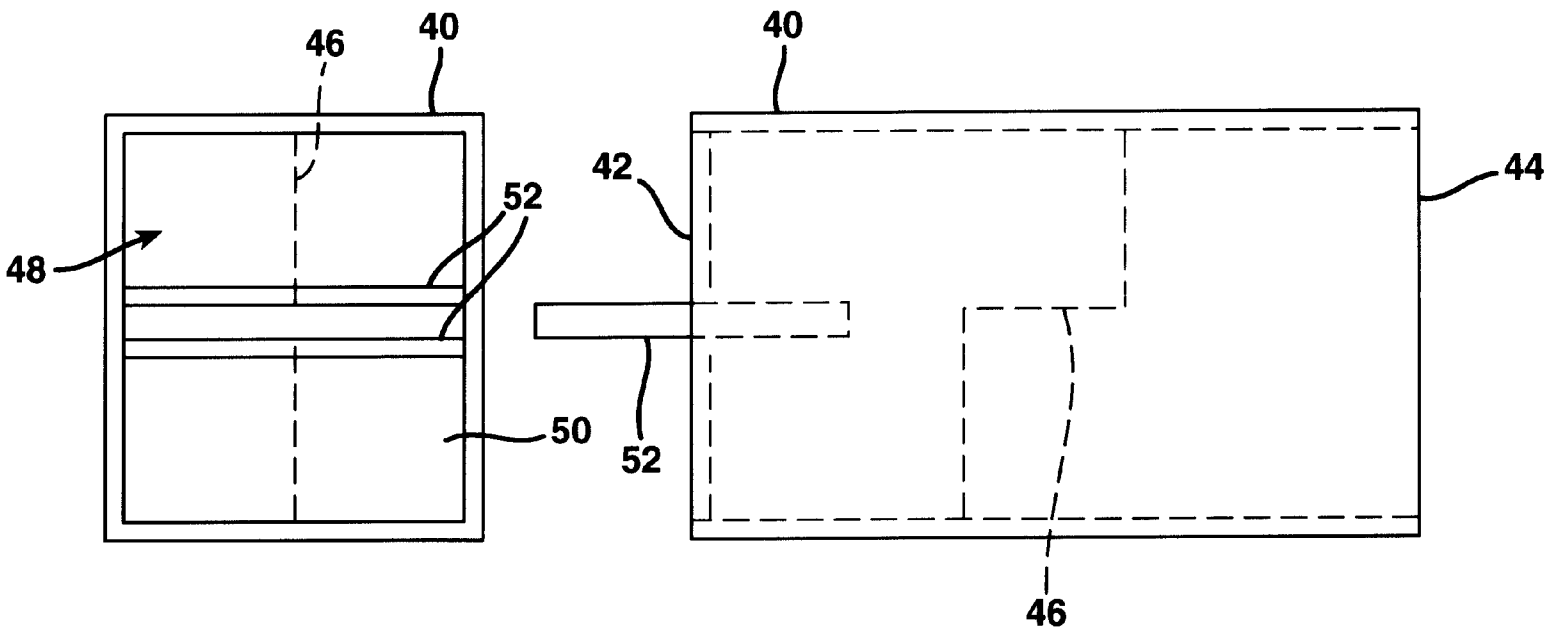
FIG. 5A is a pictorial diagram, end-view, illustrating a waveguide used as a feed radiator element in a preferred embodiment of the present invention.
FIG. 5B is a pictorial diagram, cross-sectional view, of the waveguide of FIG. 5A.

FIGS. 5A and 5B illustrate one implementation of the feed radiator 36. In this embodiment, each feed radiator 36 is formed from a wave guide 40 which includes an excitation end 42 and a radiating end 44. Each wave guide 40 contains a tapered (or stepped) internal partition 46 which gradually divides the square wave guide of the radiating end 44 into two E-plane stacked rectangular wave guide sections 48, 50. The partition 46 forms a quadrature hybrid which serves as a linear to circular polarization converter. Together, the two rectangular wave guide sections 48, 50 form the excitation end of the radiator feed 36.

Each of the rectangular wave guide sections 48, 50 are excited by one of the signal generator elements 22. Preferably, both rectangular wave guide sections 48, 50 are fed from the excitation end 42 by a microstrip assembly 52 which projects through slots in the back walls of the waveguides. This microstrip assembly contains two, coplanar, linearly polarized radiators which excite the rectangular wave guides 48, 50. To reduce signal loss, the amplifiers 34 associated with each signal generator element 22 may also be fabricated on the microstrip assembly 52 which contains the radiators.

While the feed radiator 36 has been described in the preferred embodiment as a rectangular waveguide, other feed topologies are contemplated as being within the scope of the present invention. For example, planar "tile" construction with patch radiators as well as other geometries of waveguides can readily be used in practicing the present invention.

Each beam sub-array 16 generates a transmission beam signal. Each transmission beam is radiated onto a focusing device 18 (FIG. 2). The focusing device 18 may take the form of a reflector or a lens. Preferably, the focusing device takes the form of an astigmatic dielectric lens which preshapes the received transmission beams such that each beam will project a substantially circular coverage pattern on a spherical target, such as the earth.

In a non-geosynchronous satellite transmission system, it is desirable to provide for transmit-signal stepping along the array of feeds. Transmit signal stepping refers to discrete spacial displacement of the generated transmission signal along the feed array 12 in a direction to compensate for satellite motion. By stepping the transmit-signal along the feed array, the signal is sequentially radiated in a progression of directions which are opposite to the change in direction of a fixed point on the target caused by satellite motion. Thus, the coverage area of the transmitted signal on the target remains substantially constant for a greater time period. As the present invention utilizes independent signal generators for each antenna element, transmit-signal stepping is effected by simply reassigning the frequency of the transmission beam signal generated for each antenna element.

FIG. 6 illustrates a pictorial plan diagram of an illustrative array formed in accordance with the present invention. The topology illustrated is a five column by nine row antenna array 12 of feed radiators 36. Each feed radiator 36 is labeled with a row and column designation and also labeled with the two orthogonal polarization (right hand, RH; left hand, LH). This array configuration is capable of generating and stepping sixteen signals to sixteen overlapping transmit beams.

Figure 6A:
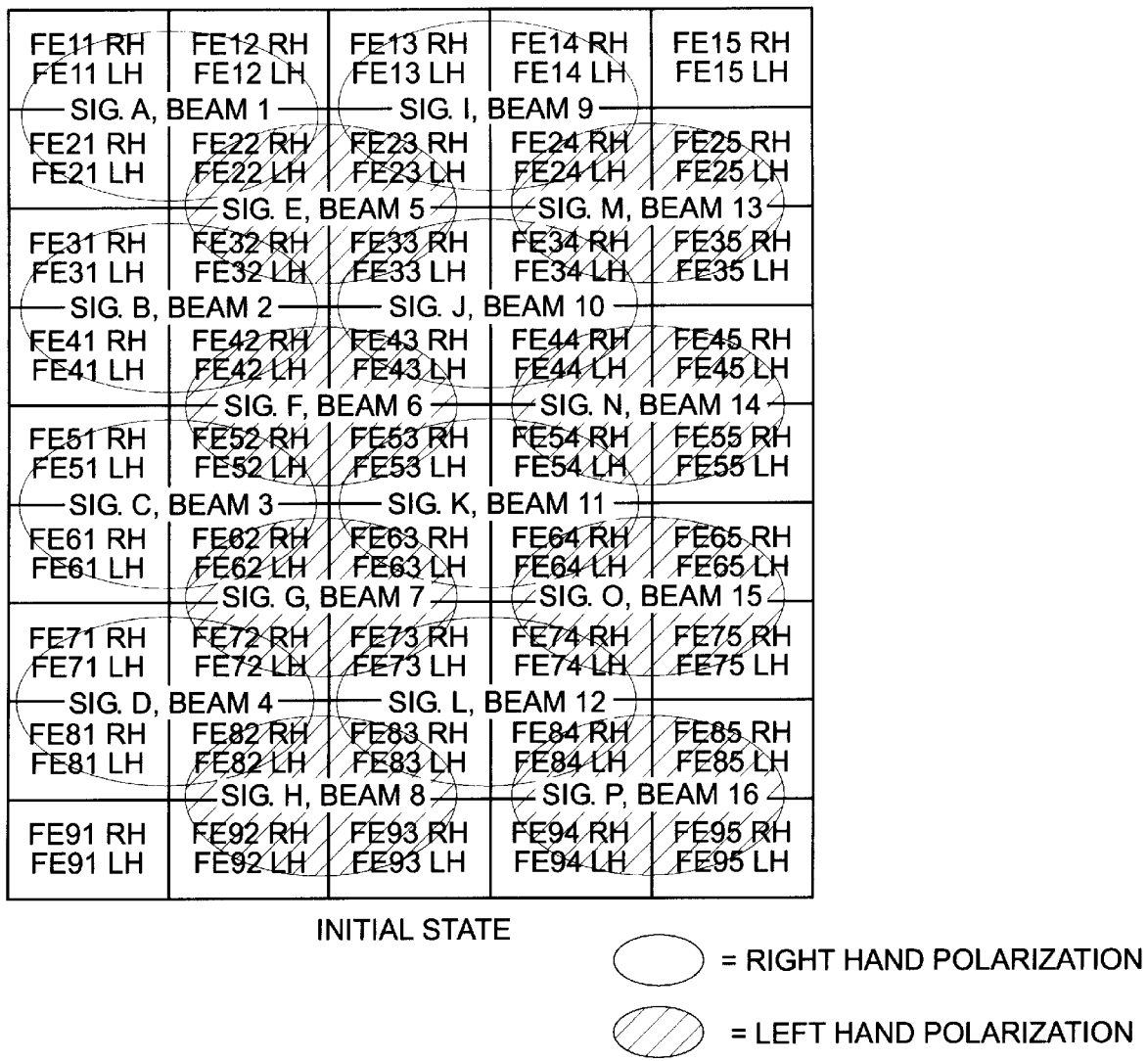
FIG. 6A is a pictorial diagram of the array illustrated in FIG. 6, further illustrating a plurality of transmit beams formed by overlapping beam sub-arrays.

Referring to FIG. 6A, the array of FIG. 6 is again illustrated along with initial beam sub-array 16 assignments for each of the sixteen transmit beams. The assignments of these beams are illustrated in Table 1 shown in FIG. 6D. In this example, the array is aligned such that the satellite motion is parallel to the columns of the array. In this alignment, the sub-arrays forming the beams need only step along a single axis of the array to compensate for satellite motion. This is preferred as it allows for simplified stepping calculations and beam stepping circuitry.

Figure 6B:
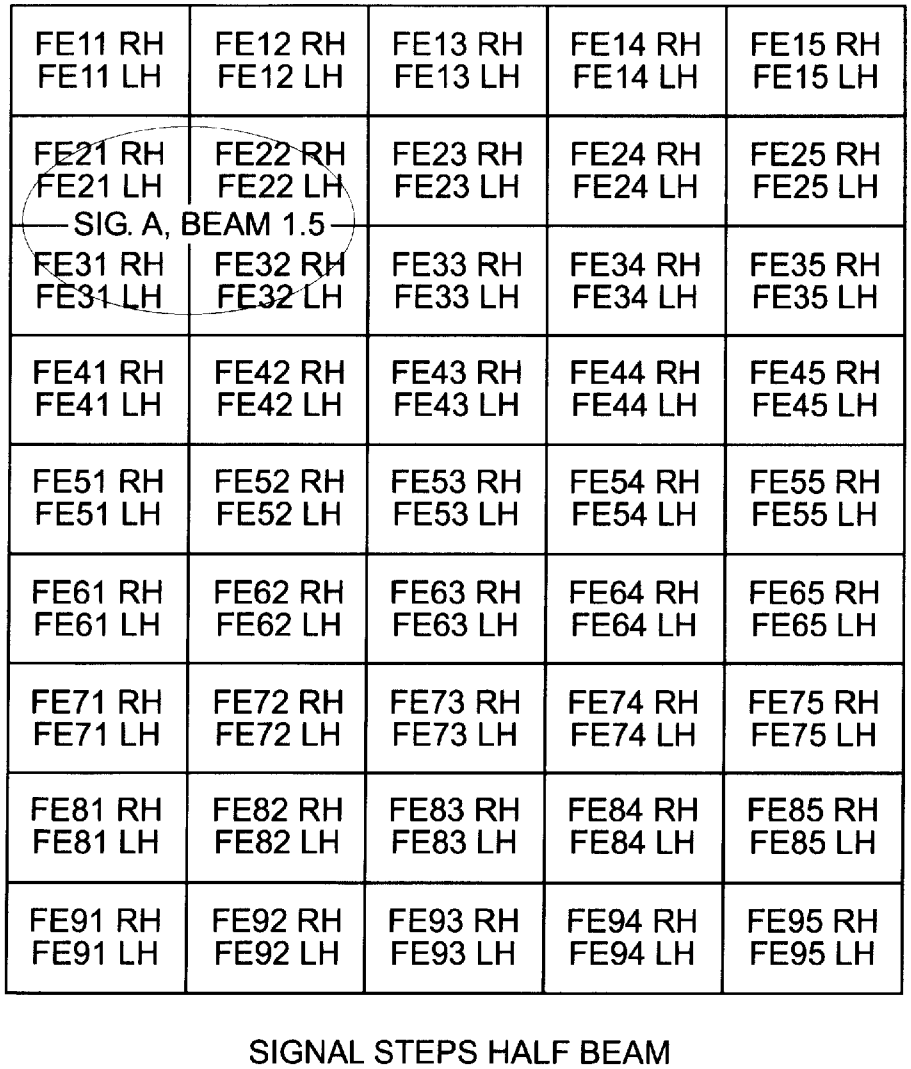
FIG. 6B is a pictorial diagram of the array of FIG. 6 further illustrating an exemplary transmission beam after stepping from a first position illustrated in 6A to a second position in FIG. 6B.
Figure 6C:
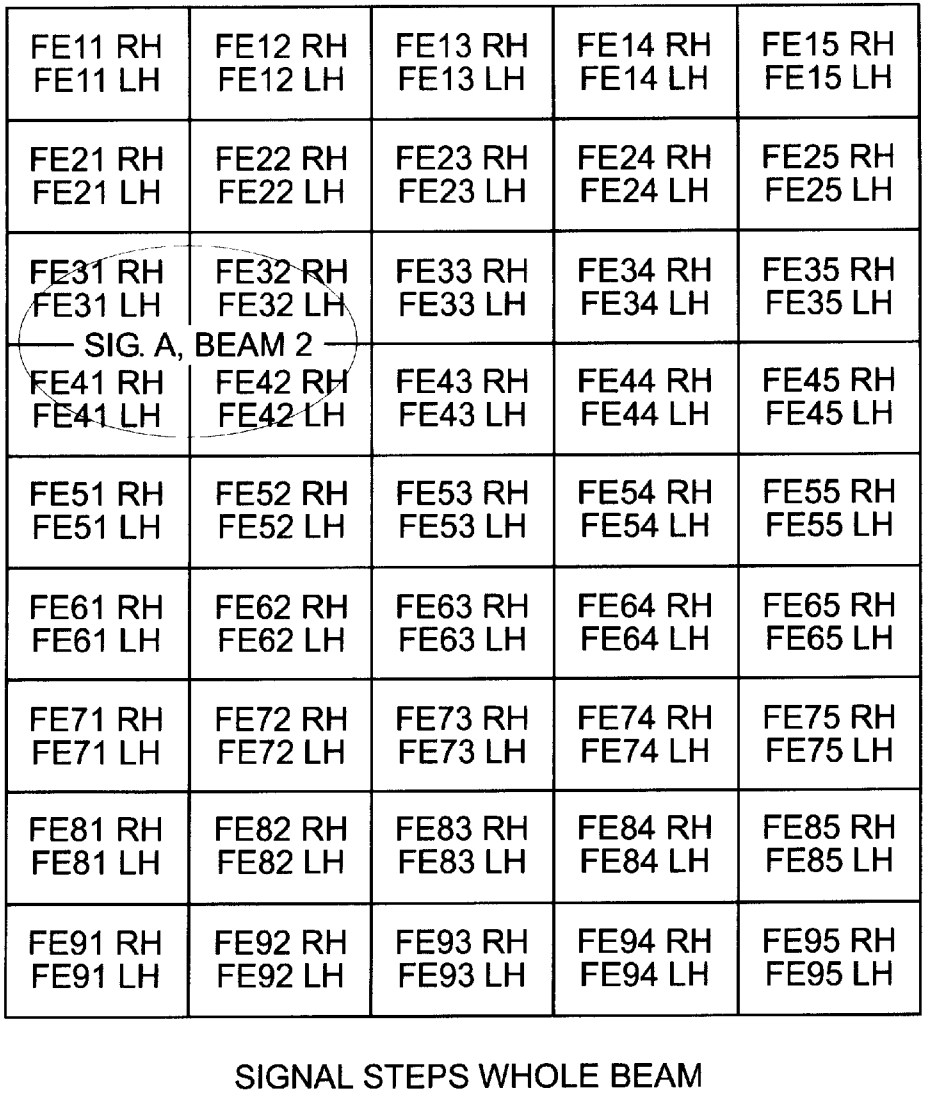
FIG. 6C is a pictorial diagram of an array illustrated in FIG. 6 further illustrating the exemplary beam after stepping from the position in FIG. 6B to a new position in FIG. 6C.

FIGS. 6B and 6C illustrate the stepping of transmit-signals initially assigned to beam 1 over two additional half beam steps. It will be appreciated that the transmit signals initially assigned to beams 2–16 are also moving in a similar fashion and have only been removed to clarify the diagrams. Tables 2 and 3, illustrated in FIGS. 6E–F, indicate the beam and feed element assignments of all sixteen transmit signals through the progression of FIGS. 6B and C respectively.

The array configurations of FIGS. 6–6F are merely exemplary. It will be appreciated by those skilled in the art that the present invention may be used to implement feed arrays of various sizes and geometries. The number of elements used to generate each beam may also be changed to alter the gain and beamwidth of the beam sub-arrays. As the size of the array 12 and beam sub-arrays 16 are altered, the number of possible transmission beams is also altered.

Figure 7:
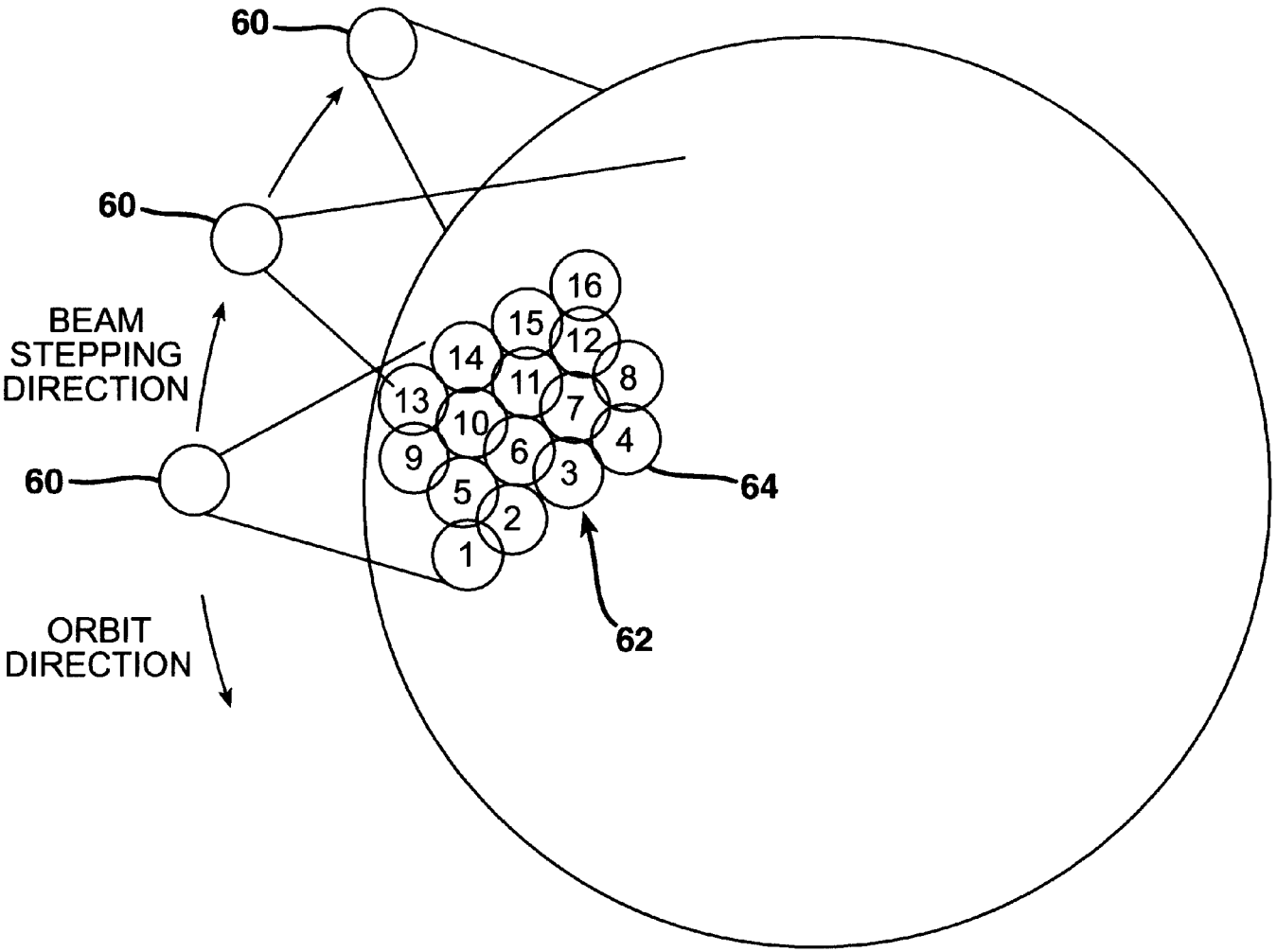
FIG. 7 is a pictorial diagram illustrating a plurality of satellites, employing a satellite transmission system formed in accordance with the present invention, orbiting and projecting beams upon a spherical target.

The present invention may be applied in a satellite communications system, such as that proposed by the Teledesic Corporation. In this application, the present invention may be implemented on a plurality of satellites. Each of the satellites is placed in a low earth orbit about a target, such as the earth, in a consecutive "string of pearls" arrangement. In this configuration, which is illustrated in FIG. 7, the satellites 60 are spaced substantially equally apart in orbit and follow one another along the path of travel. As a transmit signal "falls off" the trailing edge of one satellite array (last beam), it will be "picked up" by the leading edge (first beam) of the trailing satellite to maintain coverage 62 on the target. The transmit signal will then step down that satellite until passed again to the next trailing satellite. In this way, the target is continuously painted with coverage areas, each with a given transmit signal frequency assignment. Additional information on the Teledesic system may be found in the article by Mark Sturza, "The Teledesic Satellite System," 123–126, Proceedings of the IEEE National Telesystems Conference (1994), which is hereby incorporated by reference.

Figure 8:
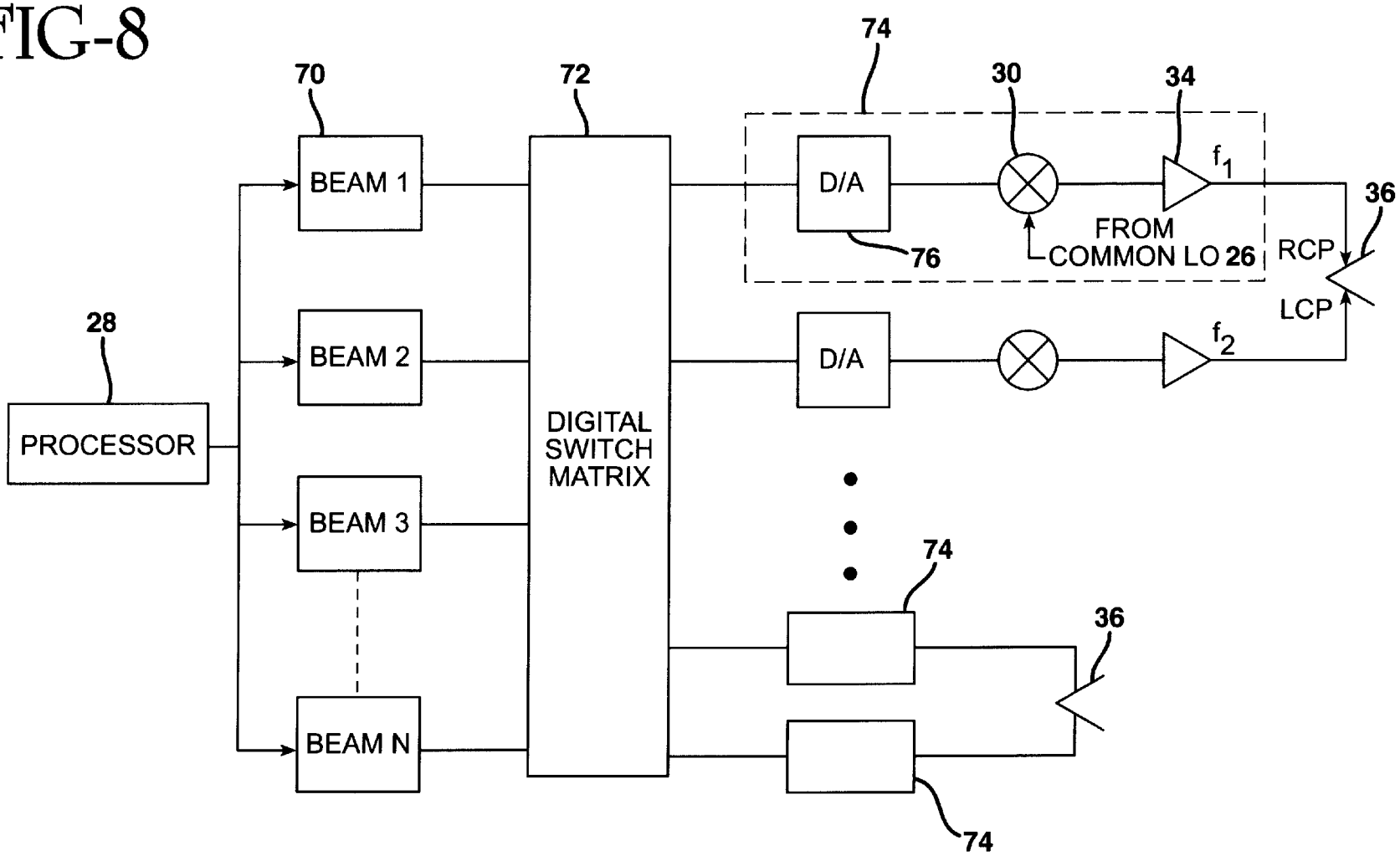
FIG. 8 is a block diagram illustrating an alternate embodiment of a satellite transmission array formed in accordance with the present invention.

An alternate embodiment of the present invention is illustrated in FIG. 8. The embodiment of FIG. 8 is characterized in that digital sine wave signals for each beam are generated by a common phase accumulator and sine look-up table (beam signal generation circuit 70). This reduces the required number of phase accumulator circuits 24A and sine look-up tables 24B by a factor which is equal to the number of feed elements forming each beam. Referring to FIG. 8, each beam generation circuit 70 is driven by a common processor 28. The output of each beam generation circuit 70 is coupled to a digital switch matrix 72.

The digital switch matrix 72 has a digital input port for each transmit beam and a digital output port for each feed element 36 in the array 12. The digital switch matrix 72 receives the digital sine wave signal from each beam generation circuit 70 and selectively routes that signal to the respective outputs currently assigned for each beam sub-array 16. To implement the example of FIG. 6, the digital switch matrix 72 would require 16 digital input ports (one per beam) and 90 digital output ports (45 feed elements with RH and LH inputs).

Each digital output of the digital switch matrix 72 is operatively coupled to a feed element driver circuit 74. Each feed element driver circuit 74 includes a digital-to-analog converter (D/A) 76 which is operatively coupled to one of the digital switch matrix 72 outputs. Each D/A 76 receives one of the transmit beam signals and generates an analog equivalent signal in response thereto. Preferably, the D/A 76 is operatively coupled to a hetrodyning circuit or frequency multiplier circuit as previously described in connection with FIG. 3. The output of the hetrodyning circuit is preferably coupled through a signal amplifier 34 to one of the feed radiator 36 inputs (RCP or LCP).

If the array is aligned along the direction of satellite motion, the topology illustrated in FIG. 8 may be further simplified. Referring to FIG. 6A, an example of a sixteen-beam array is illustrated. The array is aligned such that the columns which form the array are in substantial alignment with the direction of satellite motion. This results in four columns with each column associated with four beams. To effect transmit-signal stepping, the transmit signals are generated in one of eight possible sets of beam locations, in half beam steps, along each column. In this configuration, beams are formed by similarly activating like polarized feed element pairs of adjacent columns. For example, feed element 11RH and feed element 12RH will always be generating a common beam element signal, as would pairs 21RH-22RH, 31RH-32RH, 41RH-42RH, 51RH-52RH, 61RH-62RH, 71RH-72RH, 81RH-82RH and 91RH92RH for the beams in column 1 (beams 1–4 in FIG. 6A). Recognizing that the feed elements are energized in pairs allows the number of D/A converters 76 and hetrodyning circuits shown in FIG. 8 to be reduced by a factor of 2.

Figure 9:
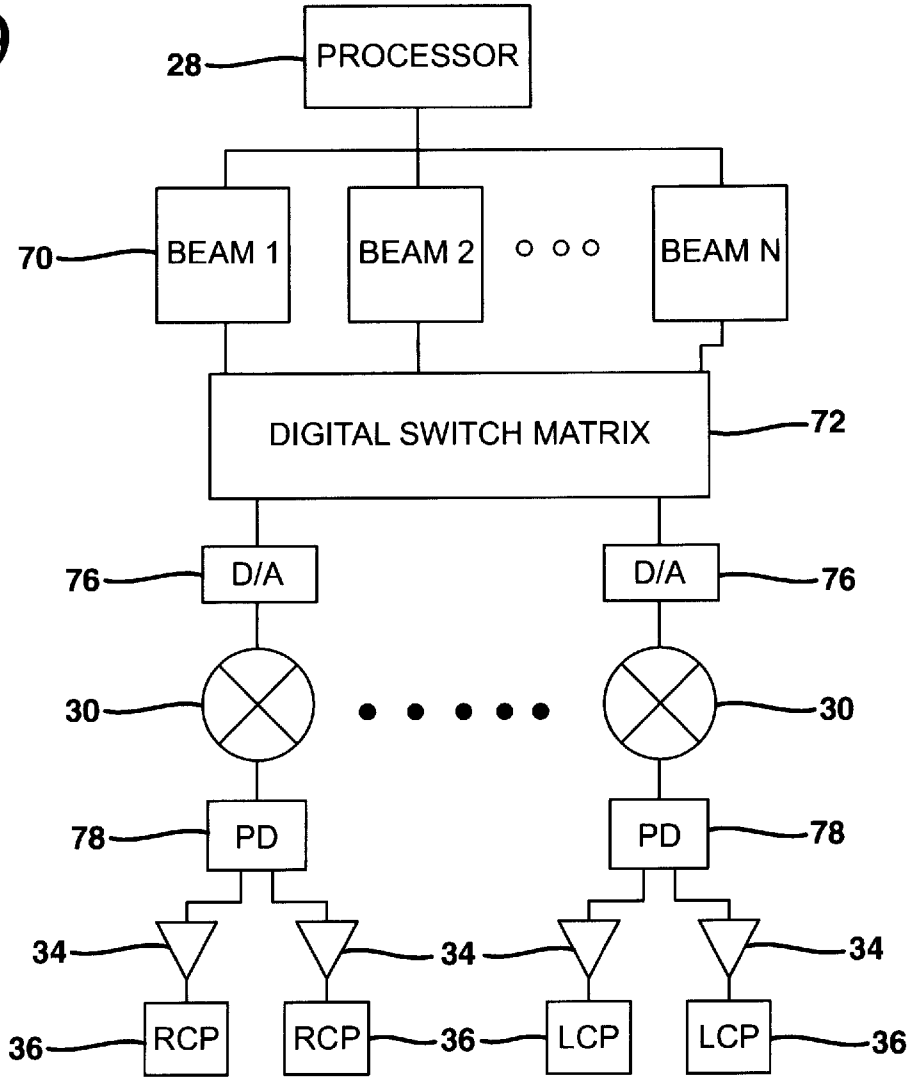
FIG. 9 is a block diagram illustrating an alternate embodiment of a satellite transmission array formed in accordance with the present invention.

Referring to FIG. 9, each output of the digital switch matrix 72 drives a sub-array pair. Each digital switch matrix 72 output is operatively coupled to a D/A 76. Preferably, the D/A 76 will be operatively coupled to an upconverter, such as a hetrodyning circuit, as previously described in connection with FIG. 3. The output of each hetrodyning circuit 30 is operatively coupled to a power divider circuit 78, such as a microstrip 3 dB hybrid splitter. The power divider circuit 78 has two equal power output ports. Preferably, each output port is operatively coupled through a separate signal amplifier 34 to a first and second adjacent feed radiator input with like polarization (RCP, LCP) 36. In this way, forty-five feed elements (90 feed element inputs) can generate sixteen stepped transmit signals using only sixteen beam generation circuits and only 36 D/A converter and hetrodyning circuits.

To generate a transmit beam, the digital switch matrix 72 directs the transmit beam signals from the beam generation circuits 70 to adjacent beam sub-array pairs. In the example shown in FIG. 6A, two such pairs are activated to create a four element, square beam sub-array. The adjacent beam sub-array pairs will be located in adjacent rows of the array 12. It will be appreciated that this technique may be expanded to larger beam sub-arrays and other sub-array geometries.

Figure 9A:
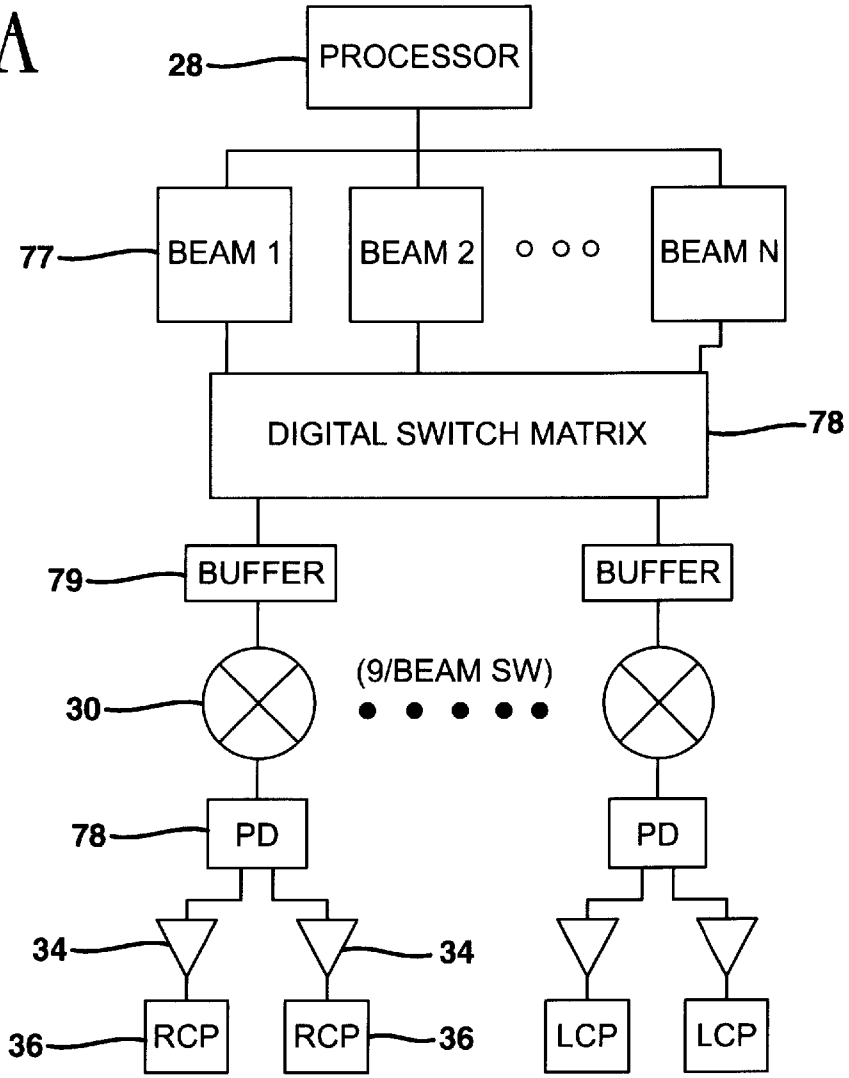
FIG. 9A is a block diagram illustrating an alternate embodiment of a satellite transmission array formed in accordance with the present invention.

For those cases where the signals generated will be modulated with pure angle modulation, the circuits of FIGS. 8 and 9 may be further simplified. Referring to FIG. 9A, rather than generating a traditional DDS address signal or digital sine wave signal, modified beam generator circuits 77 generate a "one bit" digital output signal. The one bit digital output signal is equivalent to a bi-value (0,1) analog square wave signal in which the frequency value and phase modulation information is directly represented by the time of zero crossings of the signal. This one bit digital data is routed through a modified digital switch matrix 78. The modified digital switch matrix 78 need only receive and route a single digital input line for each beam signal rather than multiple input lines required for an address signal or digital sine wave signal. This significantly simplifies the complexity of the digital switch matrix 78 and reduces the number of input and output lines significantly. The single bit digital data may be passed through a buffer 79 or directly applied to an upconverter 30 without requiring digital to analog conversion.

Figure 9B:
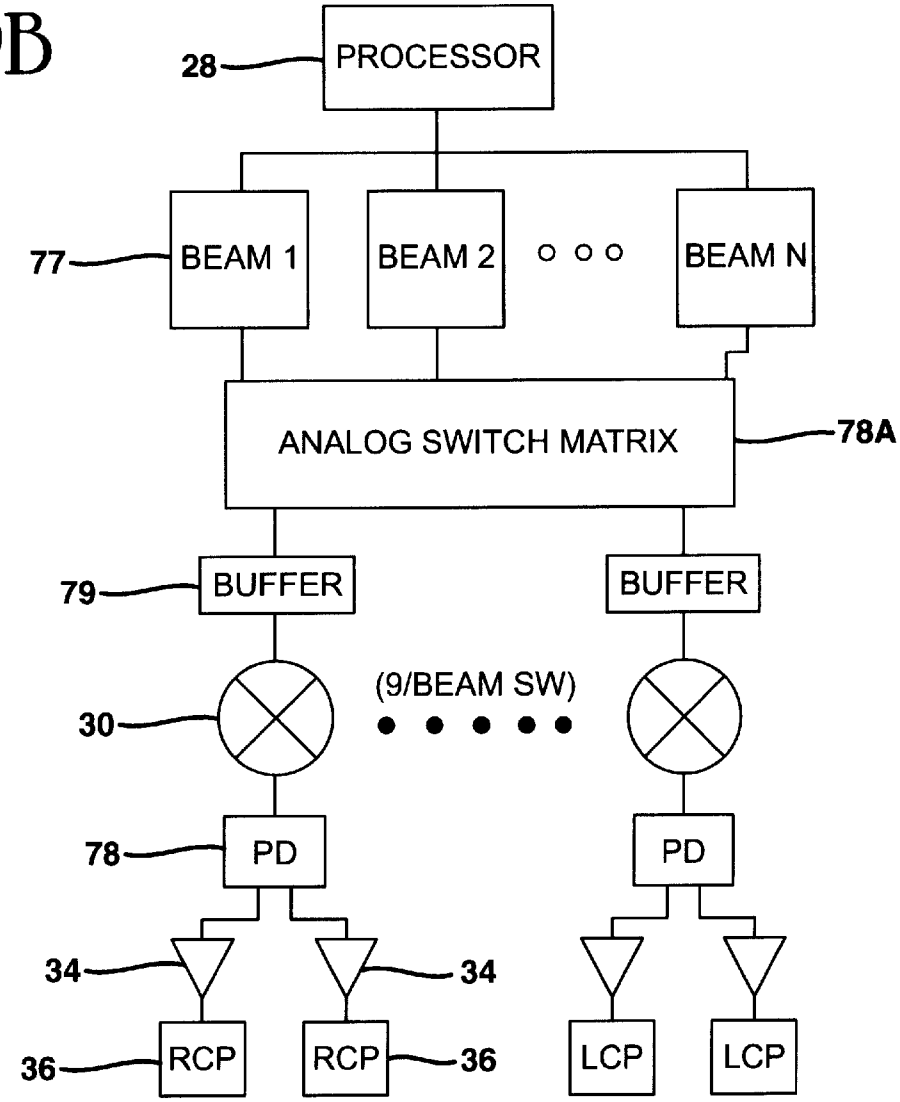
FIG. 9B is a block diagram illustrating an alternate embodiment of a satellite transmission array formed in accordance with the present invention.

Alternatively, when the "one bit" generation method is employed, a digitally controlled Analog Switch Matrix 78A may be substituted in place of the digital switch matrix, as is illustrated in FIG. 9B.

In a multiple beam transmission system, it is desirable to project the multiple beams onto the target such that uniform, overlapping coverage area results. If the sixteen beam array of FIG. 6A is employed, a typical coverage area 62 is illustrated in FIG. 7. The coverage pattern of FIG. 7 illustrates each of the sixteen beams 64 painting a circular coverage area on the target. FIG. 7 also illustrates the beam coverage areas overlapping to provide seamless coverage on the target.

Figure 10:
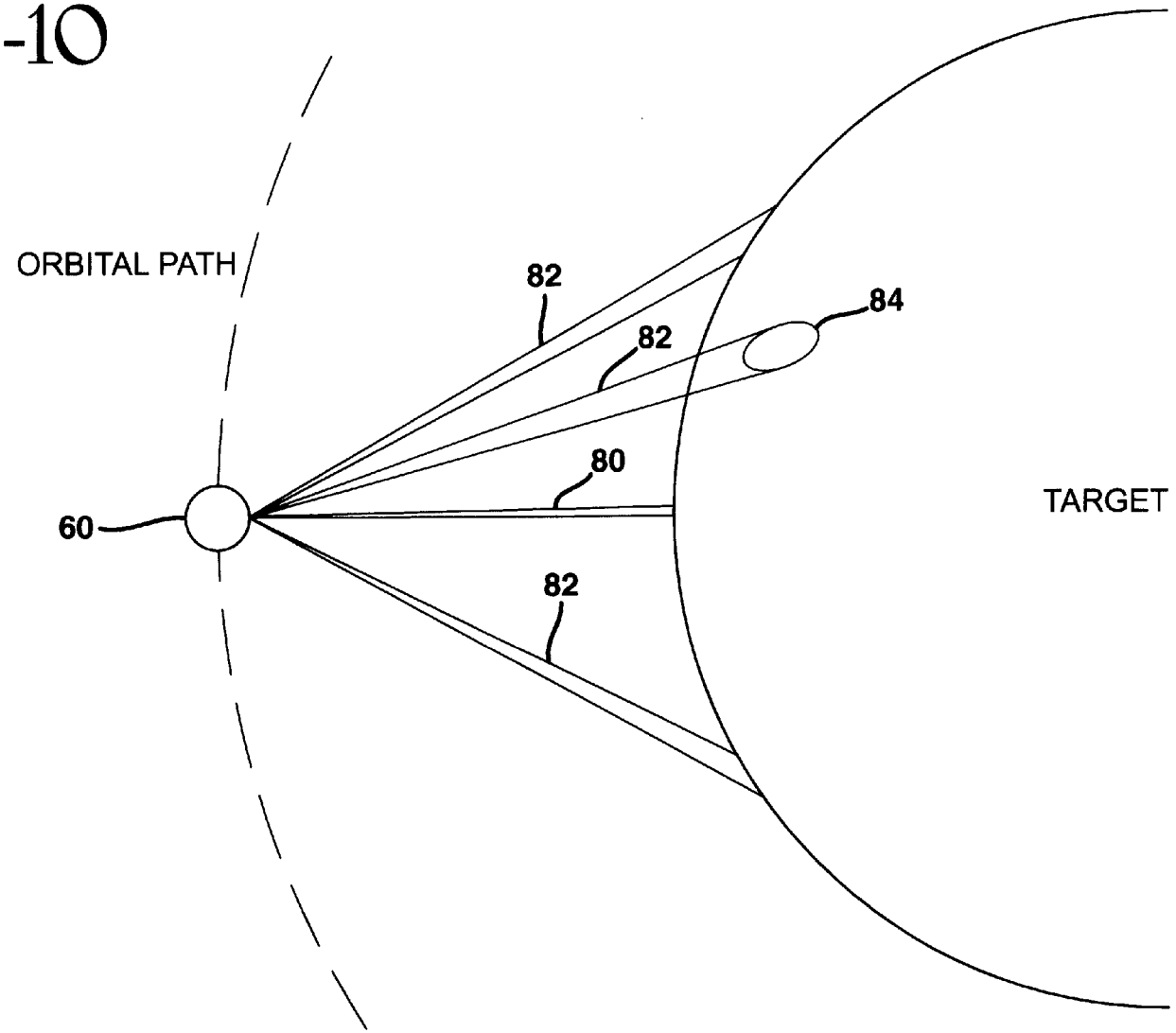
FIG. 10 is a pictorial diagram illustrating beam distortion which occurs when a beam formed by a prior art transmission system is projected at an angle upon a spherical target.

When a circular beam is projected from a satellite 60 to a spherical target, the resultant coverage area of the beam will depend upon the angle at which it is projected. Referring to FIG. 10, it can be readily seen that a circular beam projected in the nadir direction 80 will experience very little beam distortion and will establish a circular pattern on the target. However, as the beam is projected at an angle off nadir 82, the circular beam will distort on a spherical target and will result in an elliptical coverage area 84.

Figure 11:
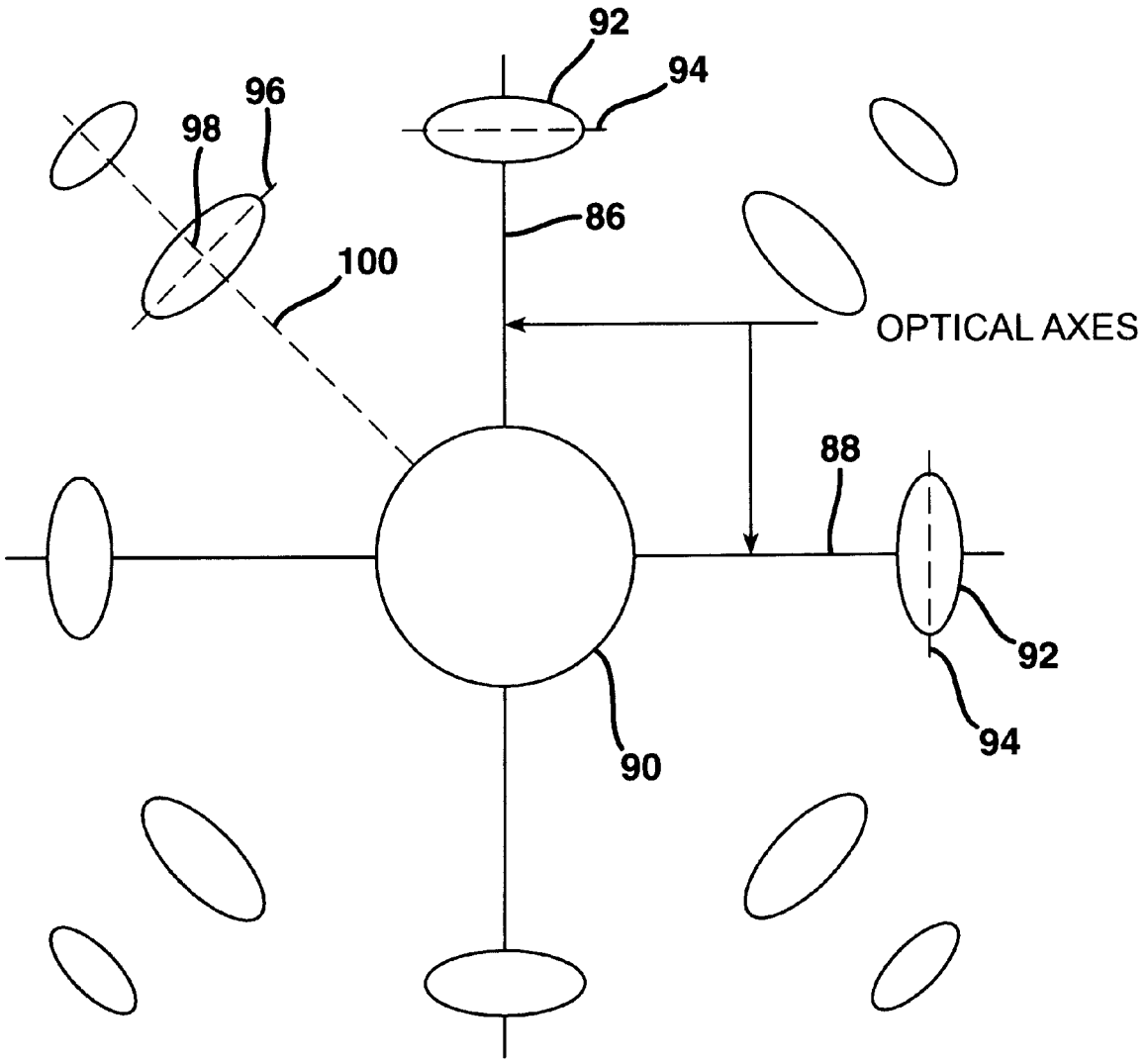
FIG. 11 is a pictorial diagram of exemplary beam shapes created by focusing means formed in accordance with the present invention.

The present invention overcomes this angular distortion by preshaping each beam upon projection. Referring to FIG. 11, various beam projection shapes are illustrated with respect to two orthogonal optical axes 86, 88 of the array 12. For those beams generated at the center of the array (projection along the nadir direction), a circular beam shape 90 is desired. Moving along either optical axes 86, 88, the beams will be progressively compressed to form elliptical beam shapes 92 having a major axis 94 which is perpendicular to the respective optical axes 86, 88 of the array. When the compressed elliptical beam 92 is projected down onto a spherical target, the beam will be "stretched" by the contour of the target, and a substantially circular coverage area will result (64, FIG. 7).

For those beams which are generated off of the optical axes of the array, an elliptical beam shape is also desired. In this case, the ellipse is compressed along both a major 96 and a minor 98 axis. The desired elliptical projection is aligned with the minor axis 98 located on a radial axis 100 of the array. In all cases, the compression of the ellipse is more pronounced at the outer perimeter of the array.

The preshaping of the beams may be accomplished by forming the focusing device 18 with astigmatism. Alternatively, a symmetrical focusing device 18 may be employed and the feed radiators 36 positioned at predetermined distances away from the focusing device 18 to selectively defocus each of the transmit beams. In either topology, this defocusing allows distortionless beam width control. This feature is possible because of the highly tapered aperture distribution provided by the overlapped feeds of the present invention. In contrast, with the minimal taper provided in prior art multiple-beam antennas, such defocusing would result in severe beam-shape distortion and very strong side lobes.

As an example of the required defocusing, consider the case of a satellite at 700 kilometers in altitude in which each beam coverage area is inscribed in a 53.33 kilometer square (as was proposed for the Teledesic system in 1994). The required beam for the nadir direction is circular, with a diameter of 6.35°. However, the required beam for a direction that is 40° from the nadir point is elliptical, and has a major axis 96 and a minor axis 98 width of 4.74° and 3.38° respectively.

An alternative method of achieving beam widths which are wider for those beams which are directed closer to the optical axis is to illuminate only the central portion of the focusing device. This partial illumination is accomplished by increasing feed sub-array size (and beam spacing) for those sub-arrays which are closer to the optical axis. Elliptical beam shape is achieved by using a rectangular rather than a square subarray. This embodiment of the present invention is particularly appropriate in connection with the use of spherically symmetrical lenses, such as the Luneberg Lens, because such lenses are not capable of producing astigmatism.

Figure 12:
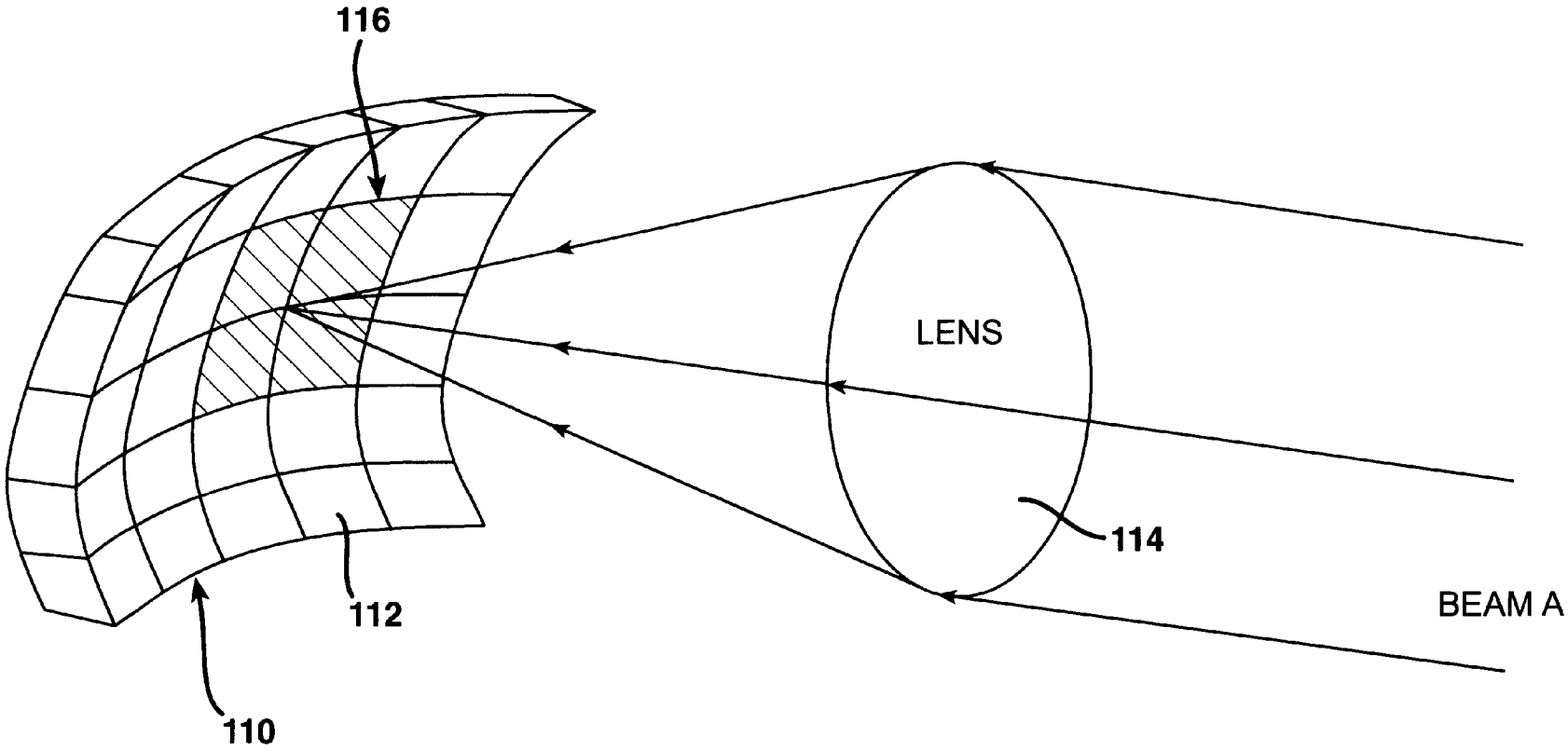
FIG. 12 is a perspective pictorial diagram of a multiple beam signal reception system formed in accordance with the present invention.

While the signal stepping array has been described in the context of a transmission array, it should be appreciated that the concepts are equally applicable to a satellite based, multiple beam, signal receiving array. FIG. 12 illustrates an exemplary receive antenna formed in accordance with the present invention.

The receive antenna includes an array 110 of receive elements 112 and beam focusing means 114. In a similar fashion to that previously described for the transmission array, the receive elements 112 cooperate to establish receive beam sub-arrays 116. Each beam sub-array 116 functions as a digitally beam formed antenna which is responsive to a signal beam transmitted from a target, such as a planet.

The beam focusing means 114 can take on any of the previously described transmission beam focusing means 18 embodiments such as an astigmatic lens, reflector or symetrical lens with varied shaped, sized and/or positioned receive beam sub-arrays 116. As the beam focusing means 114 receives multiple beam signals from discrete distant points, each received beam signal can be characterized as substantially parallel rays incident at a specific angle onto the beam focusing means. The beam focusing means 114 focuses these parallel rays onto a specific receive beam sub-array 116.

Figure 13:
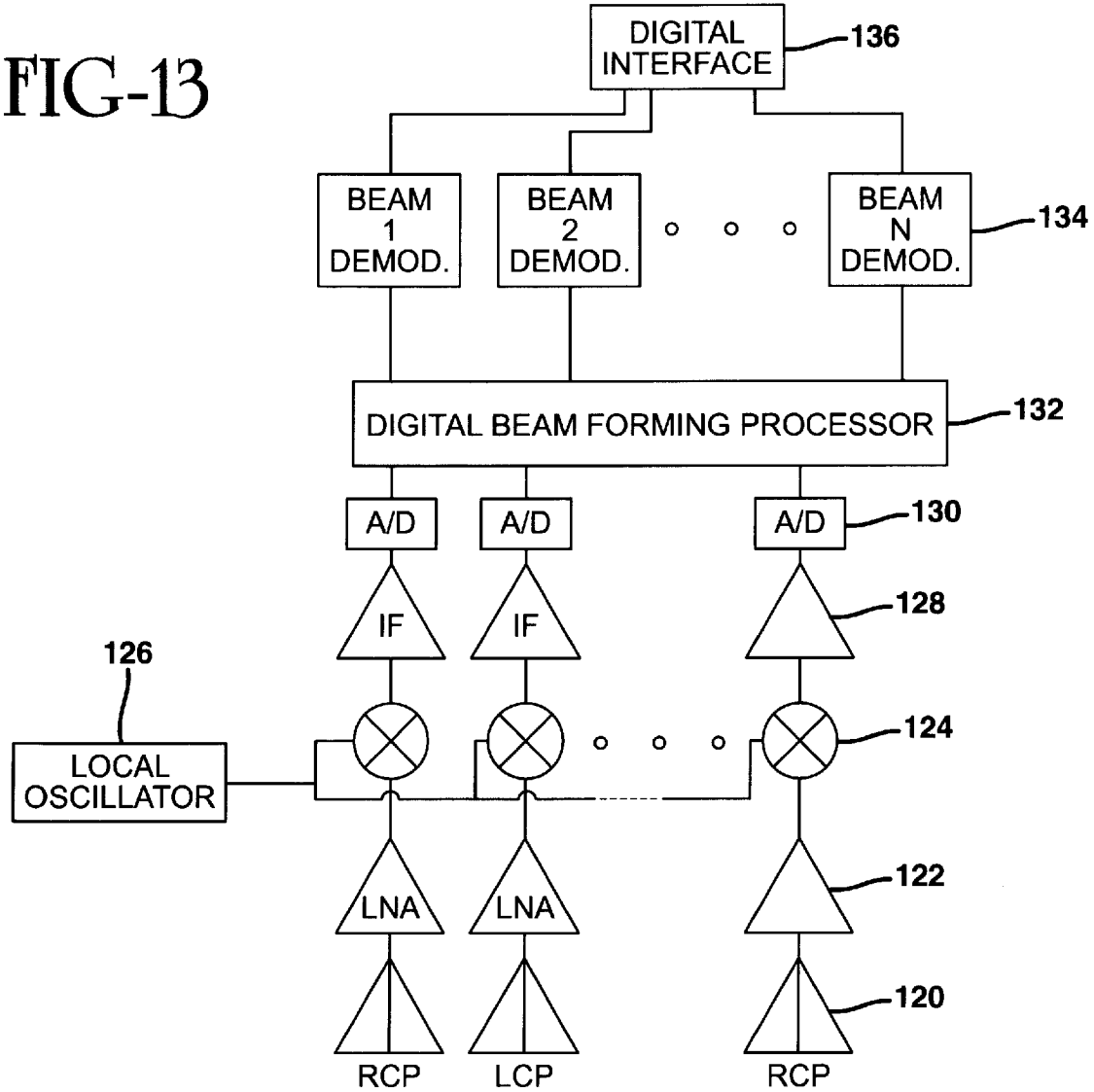
FIG. 13 is a block diagram illustrating a multiple beam signal reception system formed in accordance with the present invention.

FIG. 13 is a block diagram of a multiple beam receive antenna formed in accordance with the present invention. The receive antenna includes a plurality of receive element paths which begin with a receive feed element 120. The feed elements 120 are analogous to the transmit radiators 36. As with the transmit case, the receive feed elements 120 are arranged as orthogonally polarized pairs. The feed elements 120 are formed in a like manner to the transmit feed radiators 36 and are similarly arranged in an array. Beam element signals which are electromagnetically coupled to each receive feed element 120 are directed to a low noise receive amplifier (LNA) 122. The low noise amplifier 122 enhances the received beam element signal strength and improves the noise factor of the receive system.

The output of each LNA 122 is coupled to a mixer 124. The mixer 124 is analogous to the previously described mixer 30. A receiver local oscillator (LO) 126 is included and generates a signal which is coupled to an LO port of the mixer 124. Each mixer 124 hetrodynes the LO signal and a received beam element signal to generate a beam element intermediate frequency (IF) signal. An IF amplifier 128 receives the IF signal and provides signal gain to the beam element IF signal.

Each receive element path further includes an analog to digital (A/D) converter 130. Each AID converter 130 receives a beam element IF signal from a corresponding IF amplifier 128 and generates a digital receive element signal.

The receiver further includes a digital beam forming (DBF) processor 132. The DBF processor 132 receives the digital receive element signal from each receive element AID converter 130. The DBF processor 132assigns the individual receive element signals into beam sub-arrays 116 and performs digital signal processing, such as fast fourier analysis, to extract the receive beam signals from the beam sub-arrays 116. The DBF processor 132 has a plurality of signal outputs, corresponding to each active receive beam sub-array 116.

The receive antenna further includes a plurality of beam demodulator circuits 134 corresponding to each signal output of the DBF processor 132. Each beam demodulator circuit 134 receives a digital receive beam signal from the DBF processor 132 and extracts base band data (information) from this signal. The base band data from each beam demodulator circuit 134 is coupled to a common digital interface 136.

Figure 14:
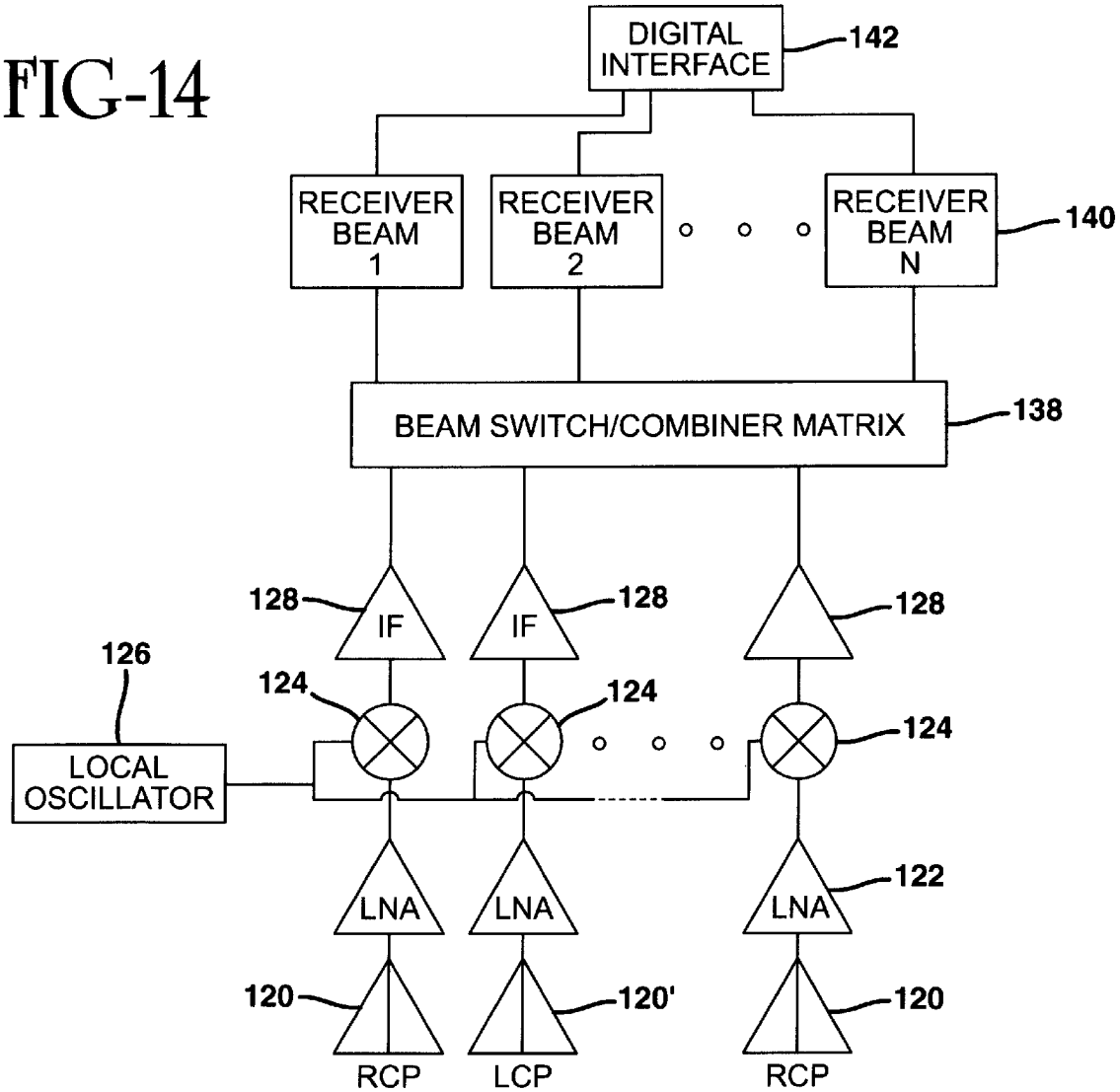
FIG. 14 is a block diagram illustrating an alternate embodiment of a multiple beam signal reception system formed in accordance with the present invention.

An alternative receiver topology is illustrated in FIG. 14. In this embodiment, the IF amplifier 124 outputs are coupled into a digitally controlled, analog beam switch/combiner matrix 138. The beam switch/combiner matrix 138 dynamically combines the individual beam element IF signals into receive beam subarray signals in a similar fashion to the groupings which were established in the previously described transmit applications.

Each receive beam sub-array signal from the beam switch/combiner matrix 138 is applied to an analog beam receiver 140. The beam receivers are formed in a conventional manner to decode the modulation applied to a particular beam signal. The beam receivers 140 output baseband data which is coupled to a digital interface 142.

It should be appreciated that the method of beam stepping for the receiver array embodiments is carried out in a method analogous to that previously described and illustrated in FIGS. 6A–6C.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An array antenna for forming multiple, overlapping, transmission beam signals in response to transmission signals from an external signal source, the array antenna comprising:

a plurality of overlapping beam subarrays, each subarray comprising;

a plurality of antenna feed radiators, each antenna feed radiator having a first signal input, a second signal input and a radiator aperture, each antenna feed radiator radiating a first signal applied to the first signal input with a first polarization and radiating a second signal applied to the second signal input with a second polarization, the second polarization being orthogonal to the first polarization, whereby each antenna feed radiator can support two radiating signals from a common radiator aperture to allow orthogonally polarized subarrays to overlap; and beam focusing means, the beam focusing means receiving the radiated signals from the plurality of antenna feed radiators and inducing required focal properties to the signals to establish a plurality of shaped transmission beam signals.

2. A multiple beam array antenna, as defined by claim 1, wherein the beam focusing means comprises a lens.

3. A multiple beam array antenna, as defined by claim 1, wherein each of the plurality of antenna feed radiators comprises a waveguide, the waveguide comprising:

a substantially hollow conductive body having a first end, a second end and a substantially square interior cross-section, the first and second ends defining a length; and an electrically conductive partition, the partition substantially bisecting the interior cross-section of the waveguide body along a portion of the length from a point proximate to the first end, whereby the first end comprises first and second rectangular waveguide sections and the second end comprises a square waveguide section, the first and second rectangular waveguide sections corresponding to the first and second signal inputs, the second end corresponding to the radiator aperture.

4. A multiple beam array antenna, as defined by claim 2, wherein the lens is formed with astigmatism to achieve the required focal properties.

5. A multiple beam array antenna, as defined by claim 4, wherein the required focal properties imparted by the lens astigmatism provide for a substantially circular beam projected in a nadir direction and progressively compressed elliptically shaped beams for those beams projected off the nadir direction.

6. A multiple beam array antenna, as defined by claim 2, wherein the lens is symmetrical and the antenna feed radiators are selectively positioned with respect to the lens to establish the plurality of shaped transmission beam signals.

7. A multiple beam array antenna, as defined in claim 2, wherein the lens is spherically symmetrical and the antenna feed radiators are selectively grouped in sub-arrays sized and shaped to achieve a substantially circular beam projected in a nadir direction and progressively compressed elliptically shaped beams for those beams off the nadir direction.

8. A multiple beam transmission system for generating a plurality of overlapping transmission beam signals, the system comprising:

a digital processor;

a plurality of antenna feed radiators, each antenna feed radiator having a first signal input, a second signal input and a radiator aperture, each antenna feed radiator radiating a first signal applied to the first signal input with a first polarization and radiating a second signal applied to the second signal input with a second polarization, the second polarization being orthogonal to the first polarization, whereby each antenna feed radiator can support two radiating signals from a common radiator aperture;

a plurality of signal generators, each signal generator having an output terminal, the output terminal being electrically coupled to at least one of the plurality of antenna feed radiator signal inputs, the signal generators being responsive to the digital processor and generating transmit beam signals in response thereto; and beam focusing means, the beam focusing means receiving the radiated signals from the plurality of antenna feed radiators and inducing required focal properties to the signals to establish a plurality of transmission beams.

9. A multiple beam transmission system, as defined by claim 8, wherein each of the plurality of signal generators comprises a direct digital synthesizer.

10. A multiple beam transmission system, as defined by claim 9, wherein the first signal input of each antenna feed radiator is operatively coupled to a corresponding first direct digital synthesizer and the second signal input of each antenna feed radiator is operatively coupled to a corresponding second direct digital synthesizer.

11. A multiple beam transmission system, as defined by claim 8, wherein the beam focusing means comprises a lens.

12. A multiple beam transmission system, as defined by claim 11, wherein the lens is formed with astigmatism to achieve the required focal properties.

13. A multiple beam transmission system, as defined by claim 12, wherein the required focal properties imparted by the lens astigmatism provide for a substantially circular beam projected in a nadir direction and progressively compressed elliptically shaped beams for those beams projected off the nadir direction.

14. A multiple beam transmission system, as defined by claim 8, wherein each of the plurality of antenna feed radiators comprises a waveguide, the waveguide comprising:

a substantially hollow conductive body having a first end, a second end and a substantially square interior cross-section, the first and second ends defining a length; and an electrically conductive partition, the partition substantially bisecting the interior cross-section of the waveguide body along a portion of the length from a point proximate to the first end, whereby the first end comprises first and second rectangular waveguide sections and the second end comprises a square waveguide section, the first and second rectangular waveguide sections corresponding to the first and second signal inputs, the second end corresponding to the radiator aperture.

15. A multiple beam transmission system, as defined by claim 11, wherein the lens is symmetrical and the antenna feed radiators are selectively positioned with respect to the lens to achieve a required shape for each of the plurality of transmission beams.

16. A multiple beam transmission system, as defined by claim 11, wherein the lens is spherically symmetrical and the antenna feed radiators are selectively grouped in sub-arrays sized and shaped to achieve a required shape for each of the plurality of transmission beams.

17. A multiple beam transmission system, as defined by claim 8, wherein the plurality of signal generators further comprise:

a plurality of beam generators, each beam generator generating a digital signal representative of one of a plurality of transmission beam signals;

a digital switch matrix, the digital switch matrix being responsive to the digital signal from each of the plurality of beam generators and routing each digital signal to at least one of a plurality of beam signal outputs; and a plurality of conversion means, each of the plurality of conversion means being operatively coupled to one of the plurality of beam signal outputs, the conversion means converting each digital signal to an analog transmit beam signal.

18. A multiple beam transmission system, as defined by claim 8, wherein each of the plurality of antenna feed radiators is operatively coupled to first and second conversion means, the first conversion means providing the first signal, the second conversion means providing the second signal.

19. A multiple beam transmission system, as defined by claim 17, wherein the system includes one beam generator for each of the plurality of transmission beams.

20. A multiple beam transmission system, as defined by claim 17, wherein each beam generator further comprises:

a phase accumulator, the phase accumulator generating an address signal; and a sine read only memory (ROM), the sine ROM being responsive to the address signal and generating the digital signal.

21. A method of generating overlapping transmission beams in an array of transmission elements with low cross-over loss and high side-lobe suppression, the method comprising the steps:

a) generating a first beam from a sub-array of transmission elements, the first beam having a first polarization; and b) generating a second beam from a second sub-array of transmission elements, the first and second sub-arrays sharing at least one transmission element, the second beam having a second polarization which is orthogonal to the first polarization.

22. A method of stepping multiple transmit signals to a sequence of beams generated in a non-geosynchronous satellite based signal transmission array and projected onto a target, the transmission array having a plurality of antenna feed radiators, the method comprising the steps of:

a) assigning frequency and polarization characteristics of each transmit signal to the antenna feed radiators to establish a plurality of overlapping beam sub-arrrays which generate a plurality of transmission beams; and b) reassigning the frequency characteristics of the antenna feed radiators to reposition the transmit signals to different beam sub-arrays, the repositioned transmit signal characteristics being re-located on the array to compensate for satellite motion such that the plurality of transmission beams provide substantially stationary target illumination for an extended time period.

23. An array antenna for receiving multiple, overlapping, transmission beam signals, the array antenna comprising:

a plurality of overlapping beam sub-arrays, each sub-array comprising;

a plurality of antenna feed elements, each antenna feed element having a first signal output, a second signal output and an antenna aperture, each antenna aperture responsive to a first signal applied with a first polarization and a second signal applied with a second polarization, the second polarization being orthogonal to the first polarization, whereby each antenna feed element can receive two overlapping, transmission beam signals with a common antenna aperture; and beam focusing means, the beam focusing means receiving the transmission beam signals and inducing required focal properties to direct the transmission beam signals onto a selected plurality of antenna feed elements forming the beam sub-arrays.

24. A multiple beam array antenna, as defined by claim 23, wherein the beam focusing means comprises a lens.

25. A multiple beam array antenna, as defined by claim 23, wherein each of the plurality of antenna feed radiators comprises a waveguide, the waveguide comprising:

a substantially hollow conductive body having a first end, a second end and a substantially square interior cross-section, the first and second ends defining a length; and an electrically conductive partition, the partition substantially bisecting the interior cross-section of the waveguide body along a portion of the length from a point proximate to the first end, whereby the first end comprises first and second rectangular waveguide sections and the second end comprises a square waveguide section, the first and second rectangular waveguide sections corresponding to the first and second signal inputs, the second end corresponding to the antenna aperture.

26. A multiple beam array antenna, as defined by claim 24, wherein the lens is formed with astigmatism to achieve the required focal properties.

27. A multiple beam array antenna, as defined by claim 26, wherein the required focal properties imparted by the lens astigmatism provide for reception of substantially circular beams incident on the lens in a nadir direction and progressively compressed elliptically shaped beams incident on the lens off the nadir direction.

28. A multiple beam array antenna, as defined by claim 24, wherein the lens is symmetrical and the antenna feed elements are selectively positioned with respect to the lens to achieve focusing required for each received transmission beam signal.

29. A multiple beam array antenna, as defined in claim 24, wherein the lens is spherically symmetrical and the antenna feed elements are selectively grouped in sub-arrays sized and shaped to receive substantially circular beams incident on the lens from a nadir direction and progressively compressed elliptically shaped beams for those beams incident on the lens off the nadir direction.

30. A multiple beam antenna system for receiving a plurality of overlapping transmission beam signals, the system comprising:

a digital processor;

a plurality of antenna feed elements, each antenna feed element having a first signal output, a second signal output and an antenna aperture, each antenna feed element being responsive to a first transmission beam signal applied to the antenna aperture with a first polarization and a second transmission beam signal applied to the antenna aperture with a second polarization, the second polarization being orthogonal to the first polarization, whereby each antenna feed element can receive two overlapping transmission beam signals from a common antenna aperture;

a plurality of signal receivers, each signal receiver having an input terminal, the input terminal being electrically coupled to at least one of the plurality of antenna feed clement signal outputs, the signal receivers providing signals to the digital processor in response thereto; and beam focusing means, the beam focusing means responsive to the transmission beam signals incident upon the beam focusing means and inducing required focal properties in the transmission beam signals to direct the transmission beam signals onto a selected plurality of antenna feed elements forming beam sub-arrays.

31. A multiple beam antenna system, as defined by claim 30, wherein the beam focusing means comprises a lens.

32. A multiple beam antenna system, as defined by claim 31, wherein the lens is formed with astigmatism to achieve the required focal properties for each transmission beam signal.

33. A multiple beam antenna system, as defined by claim 32, wherein the required focal properties imparted by the lens astigmatism provide for reception of a substantially circular beam incident upon the lens in a nadir direction and progressively compressed elliptically shaped beams for those beams incident upon the lens off the nadir direction.

34. A multiple beam antenna system, as defined by claim 30, wherein each of the plurality of antenna feed elements comprises a waveguide, the waveguide comprising:

a substantially hollow conductive body having a first end, a second end and a substantially square interior cross-section, the first and second ends defining a length; and an electrically conductive partition, the partition substantially bisecting the interior cross-section of the waveguide body along a portion of the length from a point proximate to the first end, whereby the first end comprises first and second rectangular waveguide sections and the second end comprises a square waveguide section, the first and second rectangular waveguide sections corresponding to the first and second signal inputs, the second end corresponding to the antenna aperture.

35. A multiple beam antenna system, as defined by claim 31, wherein the lens is symmetrical and the antenna feed elements are selectively positioned with respect to the lens to receive and focus transmission beams incident upon the lens from a plurality of angles.

36. A multiple beam antenna system, as defined by claim 31, wherein the lens is spherically symmetrical and the antenna feed elements are selectively grouped in sub-arrays sized and shaped to achieve the required focal properties.

37. A multiple beam antenna system, as defined by claim 30, wherein the plurality of signal receivers further comprise:

a plurality of analog to digital (A/D) converters, each analog to digital converter being responsive to one of the first and second transmission beam signals from one of the plurality of antenna feed elements, each A/D converter providing a digital receive signal to the digital processor; and wherein the digital processor is a digital beam forming processor which mathematically combines the digital receive signals received from a select plurality of AID converters to form received beam sub-arrays.

38. A method of receiving multiple, overlapping transmission beams in an array of antenna elements, the method comprising the steps:

a) receiving a first transmission beam from a sub-array of antenna elements, the first beam having a first polarization; and b) receiving a second transmission beam from a second sub-array of antenna elements, the first and second sub-arrays sharing at least one of the plurality of antenna feed elements, the second beam having a second polarization which is orthogonal to the first polarization.

39. A method of receiving multiple transmission beam signals in a non-geosynchronous satellite based signal reception array, the reception array having a plurality of antenna feed elements, the method comprising the steps of:

a) assigning frequency and polarization characteristics to each antenna feed element to establish a plurality of overlapping beam sub-arrays which receive a plurality of transmission beams, and b) reassigning the frequency characteristics of the antenna feed elements to reposition the beam sub-arrays, the repositioned sub-arrays being relocated on the array to compensate for satellite motion such that the plurality of transmission beams are received for an extended time period.

* * * * *